United States Patent [19]

McCandless et al.

[11] 4,148,161

[45] Apr. 10, 1979

[54] LOADING UNIT FOR AN AUTOMATIC BUR GRINDING MACHINE

[75] Inventors: William McCandless, Toledo; Robert F. Leu, Delta, both of Ohio; Ernest A. Kroder, Felton, Pa.; Charles J. Tomecek, Curtice, Ohio

[73] Assignee: Dentsply Research & Development Corp., Milford, Del.

[21] Appl. No.: 854,297

[22] Filed: Nov. 22, 1977

Related U.S. Application Data

[62] Division of Ser. No. 793,204, May 2, 1977, Pat. No. 4,106,242, which is a division of Ser. No. 666,848, Mar. 15, 1976, Pat. No. 4,052,821.

[51] Int. Cl.[2] ..... B24B 3/02

[52] U.S. Cl. ..... 51/215 CP; 414/740

[58] Field of Search ..... 51/215 R, 215 CP, 215 H, 51/225; 214/1 BD

[56] References Cited

U.S. PATENT DOCUMENTS

| | | | |
|---|---|---|---|
| 1,736,967 | 11/1929 | Fraser | 51/215 H |
| 2,990,656 | 4/1961 | Tompkins | 51/215 H X |
| 3,110,132 | 11/1963 | Bassoff | 51/215 H X |
| 3,114,464 | 12/1963 | Monnier | 214/1 BD |
| 3,711,997 | 1/1973 | Kushigian | 51/215 H |
| 3,863,402 | 2/1975 | Price | 51/215 H |

*Primary Examiner*—Nicholas P. Godici

*Attorney, Agent, or Firm*—C. Hercus Just

[57] ABSTRACT

A bur grinding machine especially adapted to grind dental burs and including a turntable supporting a plurality of similar workheads having collets to support bur blanks; a plurality of grinding units mounted on a stationary base in circumferentially spaced locations around the periphery of said table and respectively operable to perform different grinding operations in sequence upon the heads of bur blanks; means to index, rotate, and advance the collets of the workheads automatically at each grinding unit to form a plurality of teeth upon the bur blanks; means to index said table to advance the burs in the workheads to the next grinding unit; means to feed and accurately position bur blanks within the collets of the workheads; and means to control the cycle of the machine throughout.

1 Claim, 43 Drawing Figures

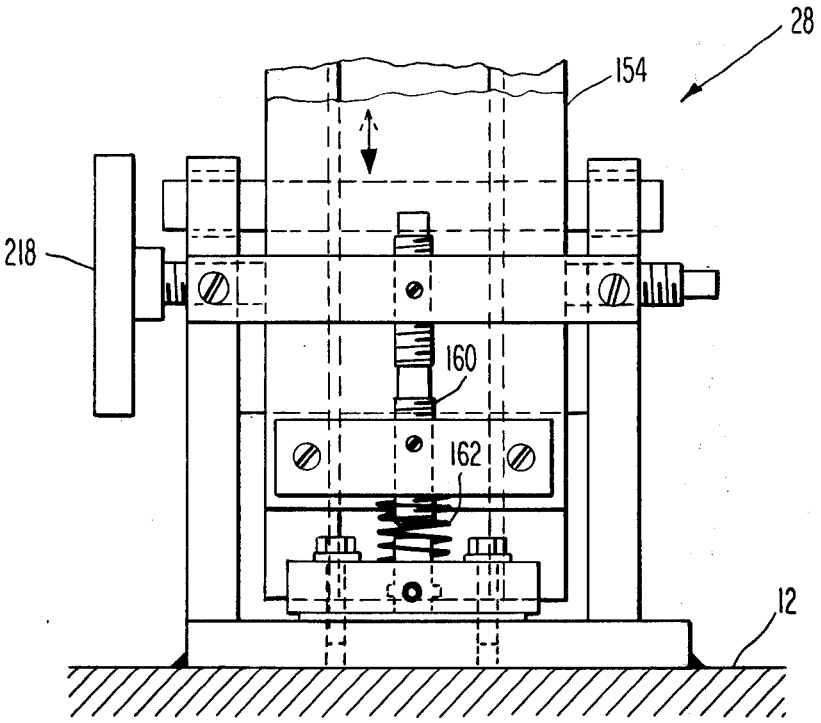
Fig. 21
Fig. 20
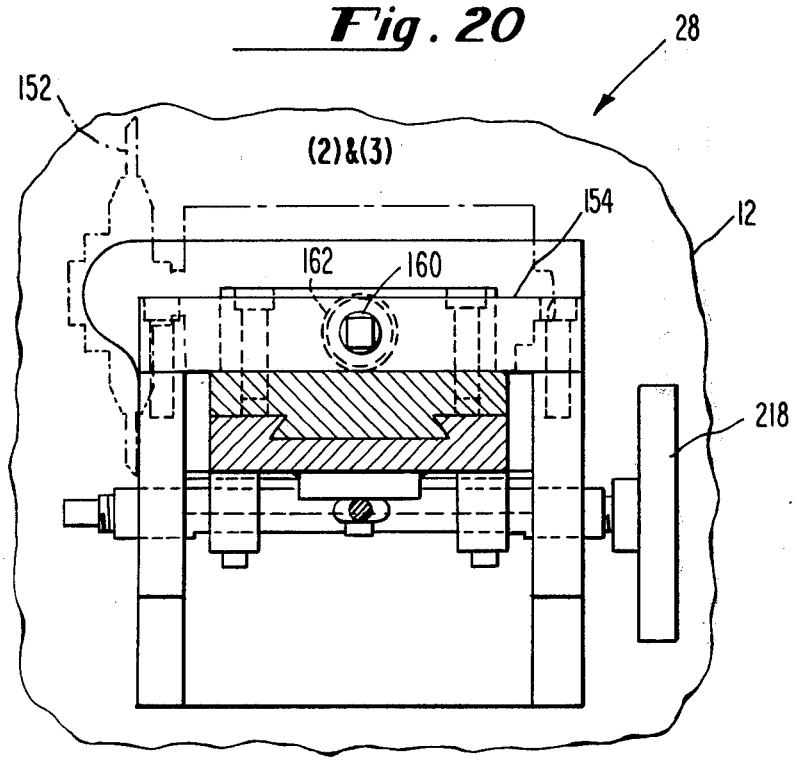

LOADING UNIT FOR AN AUTOMATIC BUR GRINDING MACHINE

This application is a division of U.S. Patent Application, Ser. No. 793,204 filed May 2, 1977 now U.S. Pat. No. 4,106,242 which is a division of Ser. No. 666,848, filed Mar. 15, 1976 now U.S. Pat. No. 4,052,821 issued Oct. 11, 1977.

BACKGROUND OF THE INVENTION

Modern straight cylindrical dental burs are generally exemplified by a design which incorporates both side and end cutting surfaces, with each cutting surface respectively having about six teeth. The most generally acceptable side tooth configuration for a cylindrical dental bur, due to the inherent self-cleaning characteristics, is that of a helix curve, wherein each such tooth is machined by grinding into the working stock of a blank bur head workpiece by two series of six successive grinding disk cuts. The first series of side tooth helical grinding cuts form six equal size abutting ogee configured grooves about the longitudinal circumference of the blank bur head workpiece and it is that series of grinding cut operations which removes the greatest amount of bur head workpiece material, as well as consuming the greatest amount of machining time. The second series of side tooth grinding disk cuts successively follows the respective groove traces formed by the first series of cuts, but is accomplished with a profiled grinding disk which forms relief surface cutting edges along the trace of each longitudinal circumferential groove cut. Lastly, a series of six separate grinding disk end cuts are made to form face teeth on the working end surface of the dental bur. Thus, it requires a total of three separate grinding disk cuts to complete each set of finished side and face teeth on a straight cylindrical dental bur of the type described, i.e., in the grinding of a straight cylindrical helically configured six side-and-face toothed bur, it requires a total of eighteen cuts by grinding disks when making a bur having the aforementioned exemplary six teeth.

The equipment which has been historically employed, as well as also that which is presently available, for grinding the aforementioned types of dental burs is generally comprised of single station grinding machines which are manually loaded and unloaded with a single blank bur head workpiece at a time, and then activated to cycle through a separate non-concurrent sequence of successive grinding and indexing operations to produce a finished dental bur in accordance with the sequential machining process heretofore described. Additionally, in the grindable machining of dental burs, it has been the custom to employ relatively small diameter grinding disks, in the size range of two-inches or so, on the bur grinding machines heretofore and presently known—being also a factor of consequence in determining overall productive capacity of said machines in that the corresponding relatively short circumferential cutting surface of such small diameter disks wear down rapidly when subjected to grindably machining the relatively hard blank bur head workpiece materials currently in use, thereby necessitating frequent replacement of worn grinding disks with new or re-dressed grinding disks, thus resulting in frequent periods of non-productive down-time for purposes of grinding disk replacement.

Progress in improving dental bur grinding machines has been slow in coming, a consequence contributed to by the attitude of secrecy which has likewise historically characterized the industry. However, machine developments made in the grinding of twist drills, an area of art similar to that of grinding dental burs, sets forth certain teachings in the automation of grinding operations. Examples of automated twist drill grinding disclosures are such as those shown and taught in U.S. Pat. No. 978,097 to Wilt, Jr., dated Dec. 6, 1910; U.S. Pat. No. 2,850,849 to Babbitt, dated Sept. 9, 1958; and U.S. Pat. No. 3,309,819 to Guhring, dated Mar. 21, 1967. The aforementioned disclosures, although they may in certain respects show machines which are somewhat structurally and functionally similar to the present invention, said disclosures are, nonetheless, mechanically, as well as operationally and patentably, distinguishable from the present invention.

The present invention pertains to a machine designed for the high-speed automated production of precision dental burs. The limiting features and shortcomings of the prior art and the collateral prior art referred to above are obviated in the design of the machine comprising the present invention, and a substantial number of improvements in the art of forming modern dental burs are provided by the machine of the present invention, detail of which are set forth in the following specification and illustrated in the accompanying drawings comprising a part thereo.

SUMMARY OF THE INVENTION

It is the principal object of the present invention to provide a machine which has a plurality of mechanically identical or similar workhead assemblies radially mounted upon a rotatable work table, whereby each workhead is adapted to accept and hold the shank of a dental bur blank workpiece within a collet fixture thereof in accurate axial and longitudinal alignment therein, said bur blank workpieces being axially delivered shank-first to said collet fixtures of said workheads from a feeding station, said work table thereafter respectively rotatably indexing said workheads—each with a bur blank workpiece retained within the collet fixture thereof—sequentially to a plurality of peripheral radially positioned grinding unit assmeblies to concurrently accomplish multiple grinding operations upon the heads of said bur blank workpieces by means of grinding disks, said grinding operations being comprised first of a series of groove cuts, followed by a coaxial series of relief cuts to form side teeth along the longitudinal circumferential surface of said heads of each of said bur blank workpieces, and thereafter followed by a series of top cuts upon the workpiece face-end of said head of said bur blanks to form miter-pointed face teeth thereon, after which the finished bur is automatically ejected from said collet into a receiving receptacle; all of the aforementioned operations of which, from feeding of the bur blank workpieces to ejection of the finished burs, are automatically accomplished by control means comprised of a predetermined machine function program.

It is another object of the present invention to provide a machine which simultaneously extends the blank bur head workpieces in an angled direction to the axis of rotation of the groove and relief grinding disks, while at the same time rotating said workpieces through an arcuate radial angle along the longitudinal axis thereof, thereby producing helical channel groove and relief cut configurations along the circumferential longitudinal surfaces of said blank bur head workpieces as heretofore described.

Still another object of the present invention is to provide a machine which incorporates grinding unit mounting means which enable angular adjustment of the grinding disks thereof relative to the longitudinal axis of said bur blank workpieces, thereby also enabling the circumferential longitudinal cutting by grinding of helical groove and relief channels having different pitch configurations, as well as enabling angularly adjustable end cuts of face teeth.

A further object of the present invention is to provide a machine having profiled grinding disks or wheels of a magnitude up to about four times the diameter of grinding disks or wheels presently employed in most conventional bur grinding operations, thereby enabling finer setting and control of the helically configured longitudinally circumferential side surface cuts upon bur blank heads, a considerably longer useful cutting life for said disks or wheels due to the greater circumferential grinding surface distance, and also less machine down-time resultant from dressing the grinding disks and/or replacing worn disks or wheels with new ones.

It is a further object of the present invention to provide a machine having, as heretofore described, a plurality of individual work stations to separately but simultaneously accomplish the multiple operations of feeding and loading bur blank workpieces, as well as groove grinding and relief grinding and top grinding of a bur blank workpiece, thereby reducing real production time and effecting a resultant increase in finished product output by concurrently performing different progressive production operations at separate work stations.

It is another object of the present invention to provide a machine having workhead assemblies which automatically index a bur blank workpiece retained therein during the retraction stroke of the bur blank after either a longitudinal circumferential groove or relief cut has been completed, thereby conserving production time which would otherwise be consumed in rotatably indexing the workpiece for the subsequent sequential cut after retraction of the workpiece.

Yet another object of the present invention is to provide a machine with workhead assemblies each of which has, as a component element thereof, an automatically activated collet that will accommodate the shanks of bur blank workpieces having different head sizes without manual adjustment of the slidable gripping jaws of said collet.

Still another object of the present invention is to provide a machine with workhead assemblies whereby the collets thereof, in combination with the automatic bur blank workpiece feed means, will enable automatic positioning of the shanks of said workpieces within said collets at a uniform depth of insertion, with a resultant uniform length of extension of the bur blank workpiece therefrom.

It is another object of the present invention to provide a machine having bur blank workpiece holding collets which automatically eject the workpiece upon completion of grinding operations.

It is also an object of the present invention to provi a machine having a functionally safe operation cycle, which minimizes manual operation time delays and operator errors, and cycles workpieces through processing operations from blanks to finished dental bur product output by a more efficient and economical manufacturing process than heretofore possible.

Details of the foregoing objects and of the invention as well as other objects thereof, are set forth in the following specification and illustrated in the accompanying drawings comprising a part thereof.

BRIEF DESCRIPTION OF THE DRAWINGS

FIG. 20 is a top sectional view of a side tooth bur head grinding station of said machine as seen along the line 20—20 of FIG. 18.

FIG. 21 is a fragmentary side sectional elevation of a side tooth bur head grinding station of said machine as seen along the line 21—21 of FIG. 19.

DETAILED DESCRIPTION OF THE INVENTION

Figure 1:
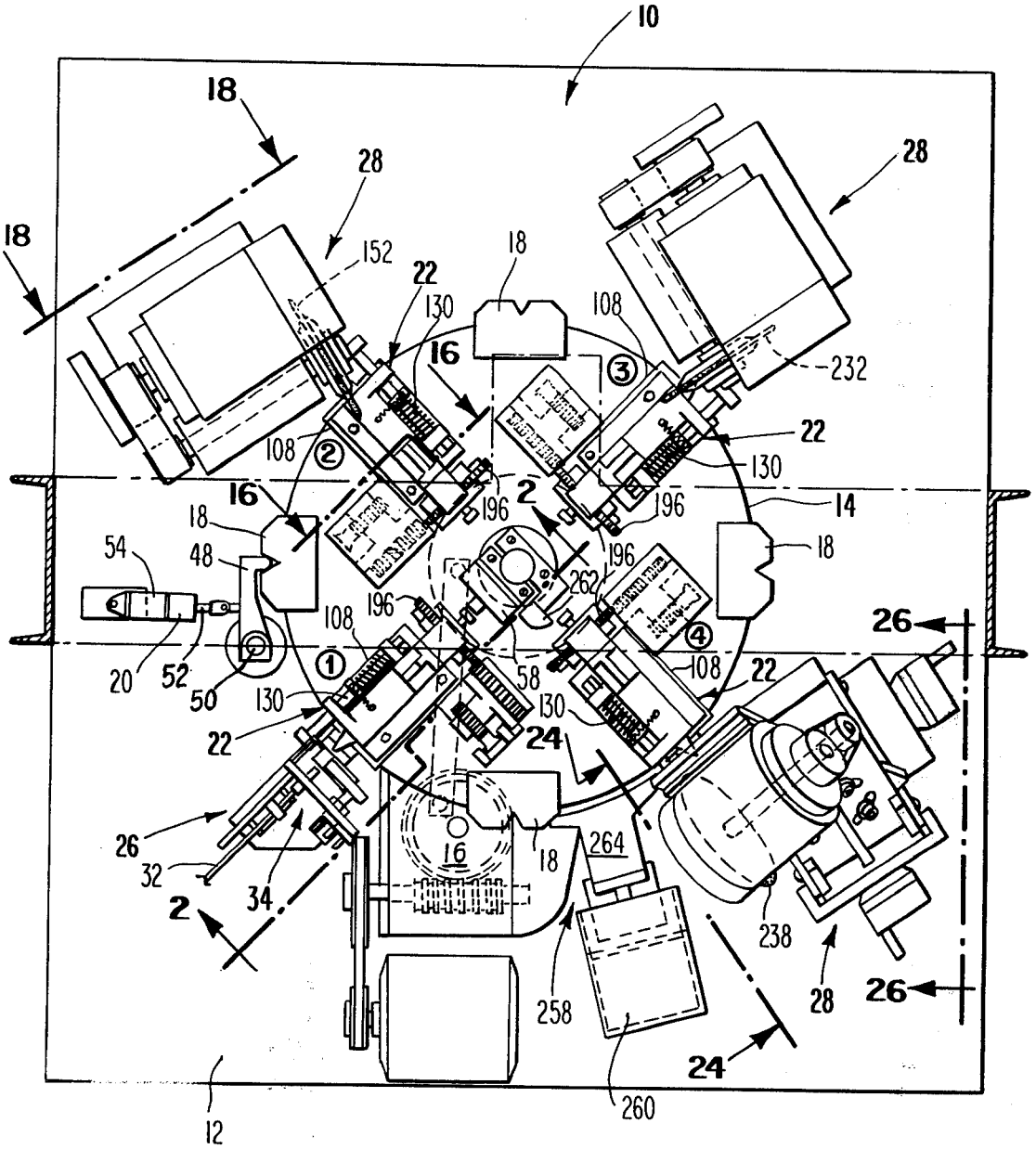
FIG. 1 is a top plan view of a bur grinding machine embodying principles and features of the present invention.
Figure 2:
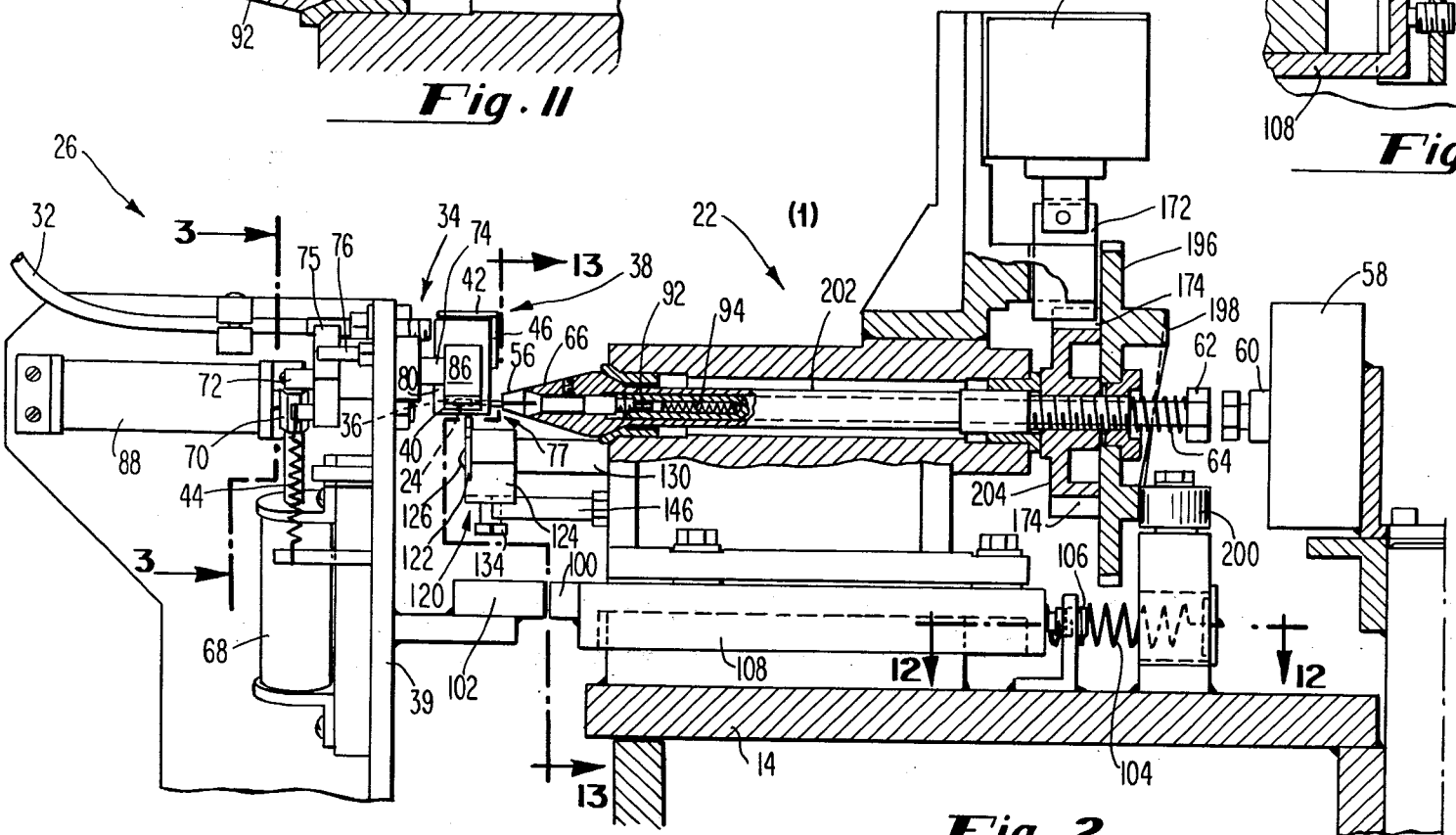
FIG. 2 is an enlarged fragmentary side sectional elevation of a workhead assembly, as well as the bur blank loading station of said machine as seen generally along the line 2—2 of FIG. 1.
Figure 23:
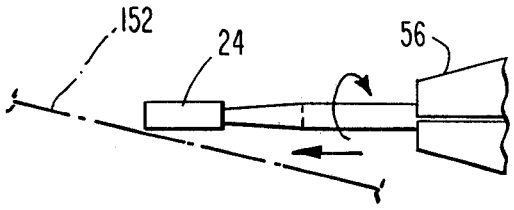
FIG. 23 is a plan view as seen along the line 23—23 of FIG. 22.
Figure 22:
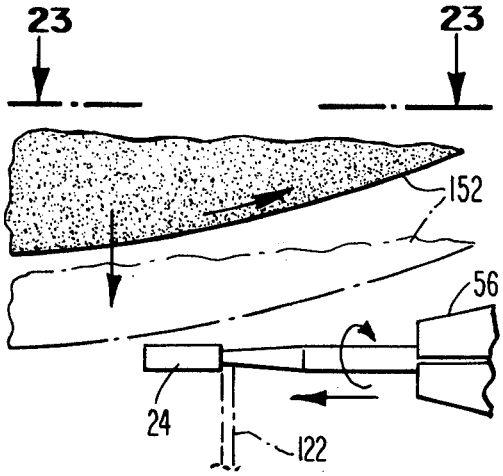
FIG. 22 is an enlarged fragmentary side sectional view of the side tooth bur head grinding station grinding wheel/bur head relationship as shown within the area designated 22 of FIG. 19.
Figure 29:
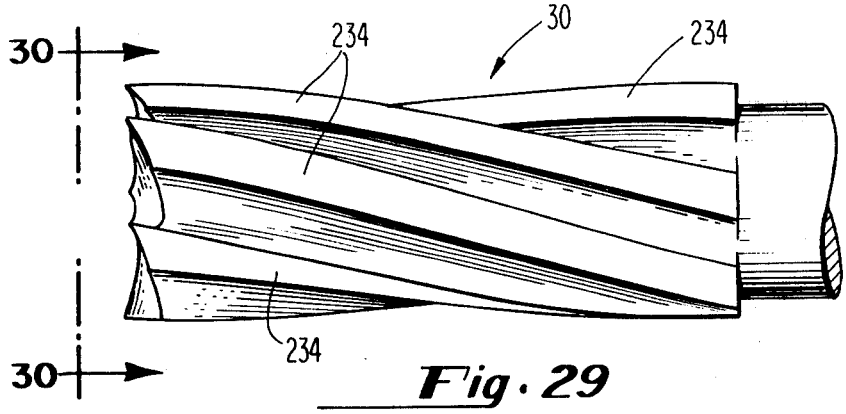
FIG. 29 is an enlarged fragmentary side elevation of a completed exemplary dental bur produced by employing the machine embodying principles of the present invention.
Figure 30:
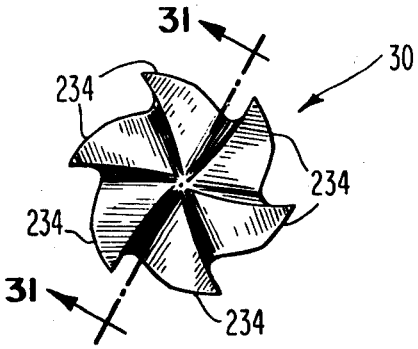
FIG. 30 is an end elevation of the exemplary dental bur as seen along the line 30—30 of FIG. 29.
Figure 31:
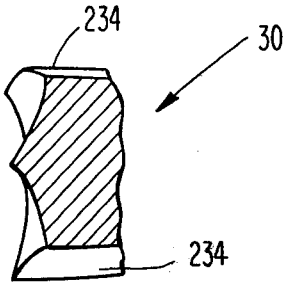
FIG. 31 is a fragmentary side sectional elevation of the exemplary dental bur as seen along the line 31—31 of FIG. 30.

Referring to FIG. 1, the present invention is shown which comprises a multi-station dental bur grinding machine 10 having a supporting frame structure 12 comprised of interconnected horizontally and vertically disposed structural frame members, a rotatably driven indexing table 14 which is indexically advanced in a clockwise rotary direction by a Geneva gear drive 16, said indexing table 14 having mounted thereon a plurality of indexing lock stops 18 which sequentially cooperate in mechanical engagement with indexing lock station 20 to accurately register a corresponding plurality of indexing table-mounted workhead assemblies 22 that automatically receive blank dental bur head workpieces 24, said blank dental bur head workpieces not being illustrated in FIG. 1, but shown in FIG. 2 and certain of subsequent figures, especially FIGS. 22 and 23, etc., from bur blank loading station 26 and hold said workpieces 24 in accurate locked position at a plurality of electrical motor-powered grinding stations 28 for subsequent automatic sequential grinding formation of said workpieces 24 into finished straight cylindrical helically-configured six side-and-face toothed dental burs 30, such as respectively illustrated in FIGS. 29, 30, and 31.

Referring again to FIG. 1, to explain the general concept of operation of the present invention, prior to which it should be noted that although the details and descriptions hereinafter set forth, in the interests of clarity, will relate singularly to the employment of said machine 10 for formation by grinding, of straight cylinder and tapered cylinder, helically configured and inverted cone type dental burs, said machine 10, as illustrated, is arranged to produce such burs with six teeth, but with adjustment of the indexing mechanism, a different number of teeth may be formed.

BUR BLANK FEEDING MECHANISM

Initially, blank dental bur head workpieces are manually loaded into a standard electromagnetic vibratory bowl feeding device, not shown, but, however, of a type well-known in the art. The machine 10 is then activated by turning on a master switch, likewise not shown, which provides power to the respective drive and operational sensing means of said machine 10 through an electronic control panel, also not shown, but the same similarly being well-known in the art, through which control panel the electromagnetic, mechanical, hydraulic, pneumatic, and electrical functions of said machine 10 are sequentially pre-programmed during the machine setup as timed, mechanically-coordinated, multi-concurrent, machine-indexing stop, function, and operational cycles to automatically complete the respective bur feeding, grinding, and processing procedures are accomplished by employing the present invention.

BUR BLANK LOADING STATION (1)

Figure 3:
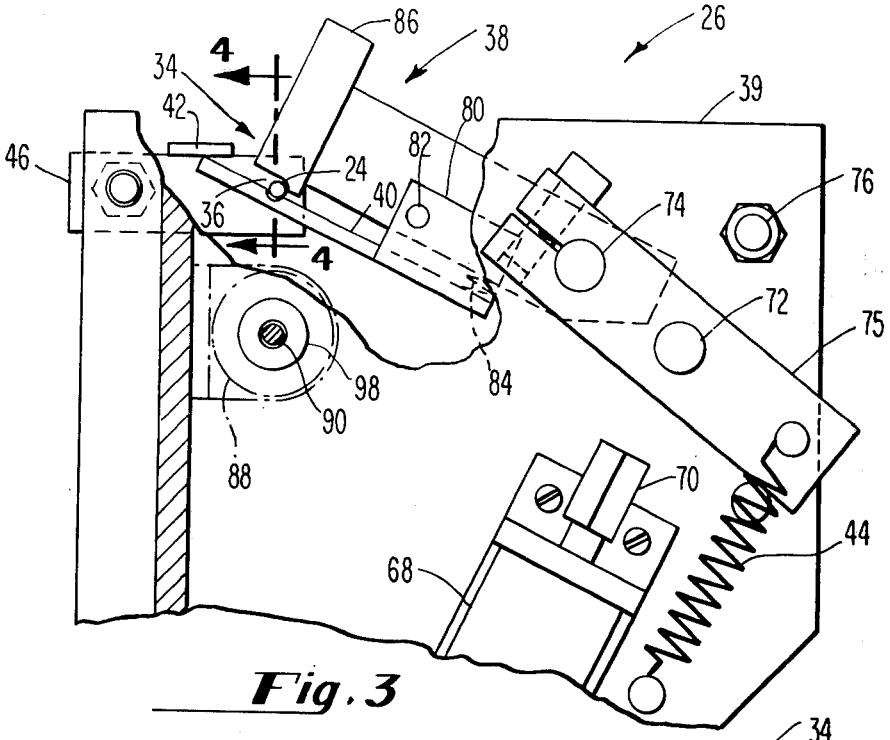
FIG. 3 is an enlarged fragmentary front sectional elevation of the bur blank loading station as seen generally along the line 3—3 of FIG. 2.

By means of the aforementioned vibratory bowl feeding device said blank dental bur head workpieces 24 are oriented, shank-leading, and mechanically introduced to the depending bur blank loading station feed tube 32 and therethrough, in an abutting linear, shank-leading arrangement, and during a machine indexing stop, are gravitationally delivered to the loading station staging position 34 for the bur blanks, where a single blank dental bur head workpiece at a time is fed to and positioned in the stop block feed slot 36 of the loading station stop block assembly 38 which is pivotally secured through mounting plate 39, said block feed slot 36 not being shown in FIG. 1, but illustrated in FIG. 3 and certain of other subsequent Figures.

Figure 4:
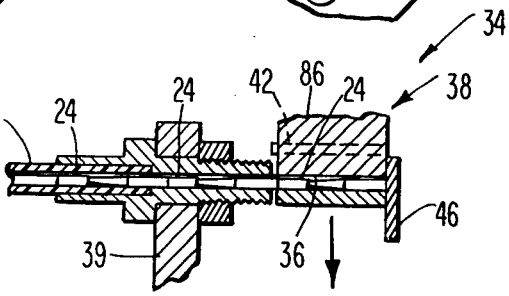
FIG. 4, is an enlarged fragmentary side sectional elevation of the bur blank loading station shown in the load staging position as seen generally along the line 4—4 of FIG. 3.

As is particularly illustrated in FIG. 3, during feedable positioning of a blank dental bur head workpiece 24 in the stop block feed slot 36, said stop block feed slot is held in an open position by retracted engagement of the pivotally affixed grooved stop block feed slot clamping arm 40 with bar member 42 under retractive spring force provided by the stop block tension spring 44, whereby the lineal advance of a blank dental bur head workpiece 24 delivered to said stop block feed slot 36 is registerably limited by the feed station stop bar 46, as seen in FIG. 4.

Figure 6:
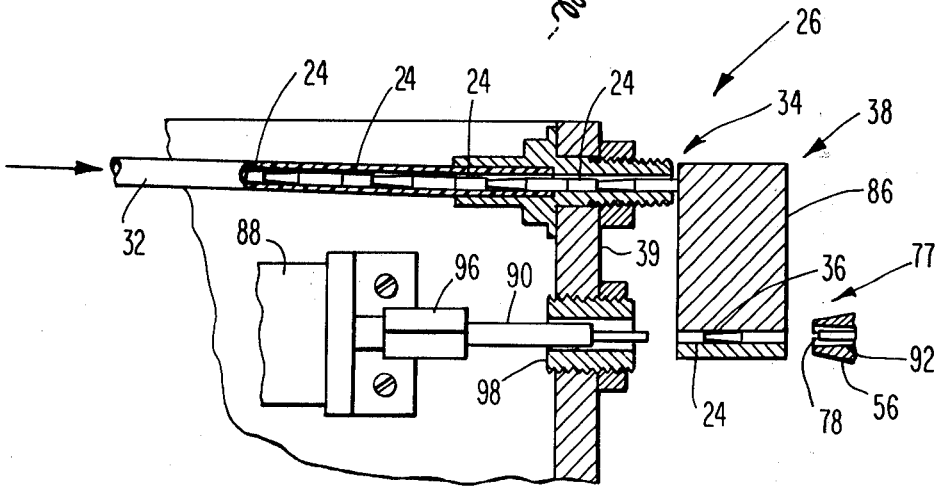
FIG. 6 is a side sectional view of the bur blank loading station as seen along the line 6—6 of FIG. 5.
Figure 7:
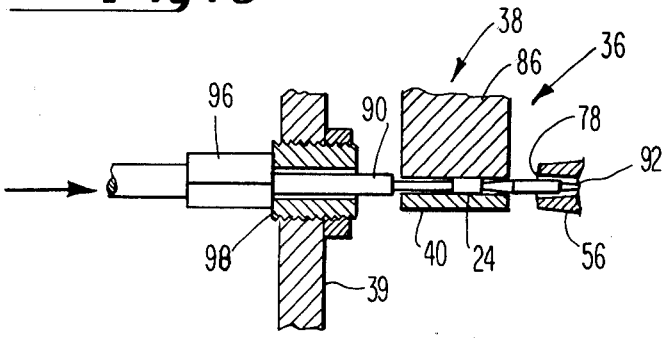
FIG. 7 is a fragmentary side sectional view of the bur blank loading station similar to that shown in FIG. 6, but, however, showing the feeding of a blank bur head workpiece to the collet clamping jaws of a workhead assembly.

It should be noted that during the entire blank feeding operation of a dental bur workpiece, the indexing lock station pawl 48, see FIG. 1, which is pivotally affixed by means of pivot pin 50 to the supporting frame structure 12 of machine 10, is held in engageable lock position with the respective indexing lock stop 18, positioned at the indexing lock station 20, by means of the automatic extension of cylinder rod 52 upon transmission of a preprogrammed input signal to the control panel to energize the indexing lock station hydraulic cylinder 54, thereby extending cylinder rod 52 and engageably securing the subject workhead assembly 22, mounted upon indexing table 14, in accurate rotary registration for receiving a blank dental bur head workpiece during subsequent automatic feeding of said workpiece 24 to the collet clamping jaws 56 of workhead assembly 22 at the indexing table Station 1 location, the operational sequence of which is respectively illustrated in FIGS. 6 and 7. It should be further noted that the location of the indexing table 14 operational Station 1 positionally relates to the bur blank loading station 26, which operational location will hereinafter, as appropriate, be indicated on the respective drawings included herewith by the designation (1), as will other operational stations hereinafter described being likewise respectively designated by an appropriate number symbol.

Figure 28:
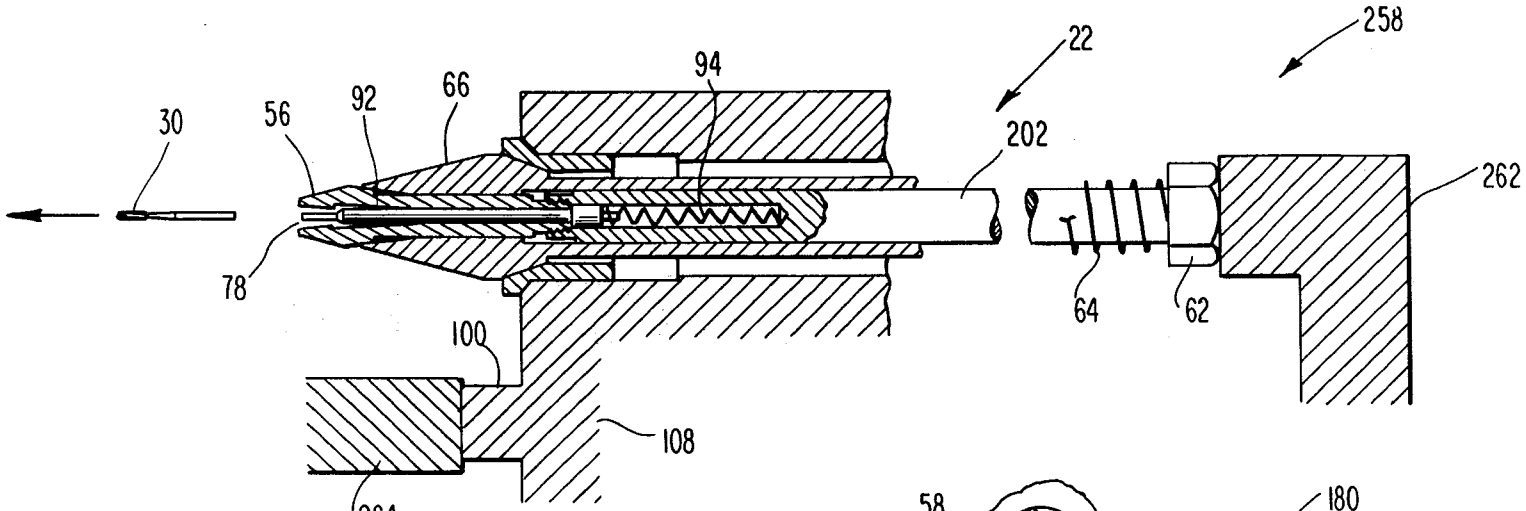
FIG. 28 is an enlarged fragmentary side sectional view of the workhead assembly collet clamping means shown in the eject position as seen generally along the line 28—28 of FIG. 27, as well as also showing a completed exemplary dental bur being propelled therefrom.

Upon positioning of a blank dental bur head workpiece 24 in the stop block feed slot 36 as heretofore described, and best illustrated in FIG. 2, the pancake cylinder 58 of machine 10 energizes and extends the pancake cylinder plunger rod 60, which compressively engages the spring extended collet pusher rod 62 of the workhead assembly 22 located at Station 1, thereby compressing the collet pusher rod spring 64, shown in FIGS. 2 and 28, whereupon the collet clamping jaws 56, which are threadably affixed to said collet pusher rod 62, are extended forward from the collet clamping jaw housing 66, thereby enabling said clamping jaws, which are sprung axially outward, to open for receiving the shank of a blank dental bur head workpiece 24 fed thereto.

Figure 5:
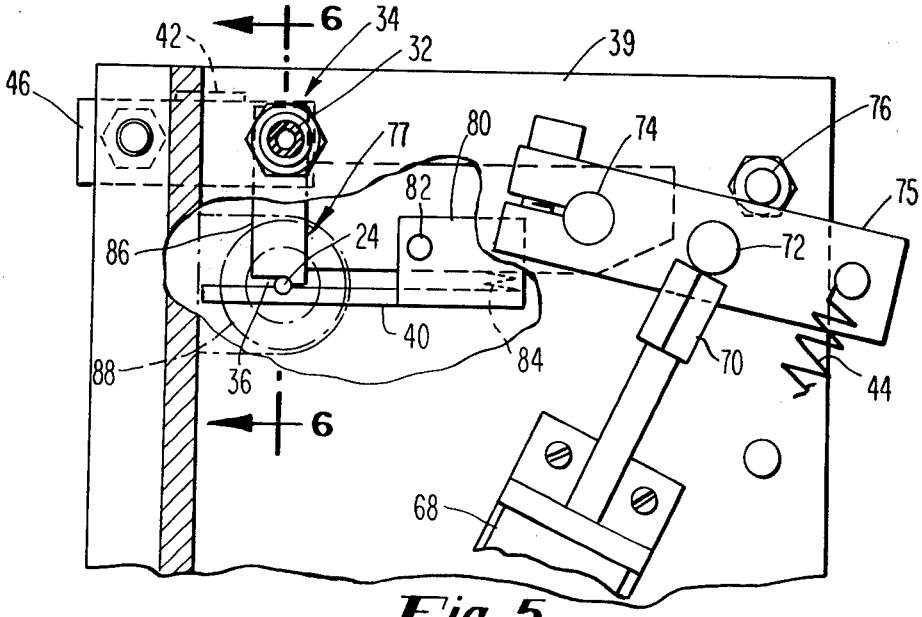
FIG. 5 is an enlarged fragmentary front sectional elevation of the bur blank loading station similar to FIG. 3, but, however, showing said bur blank loading station lowered into the feeding position.
Figure 10:
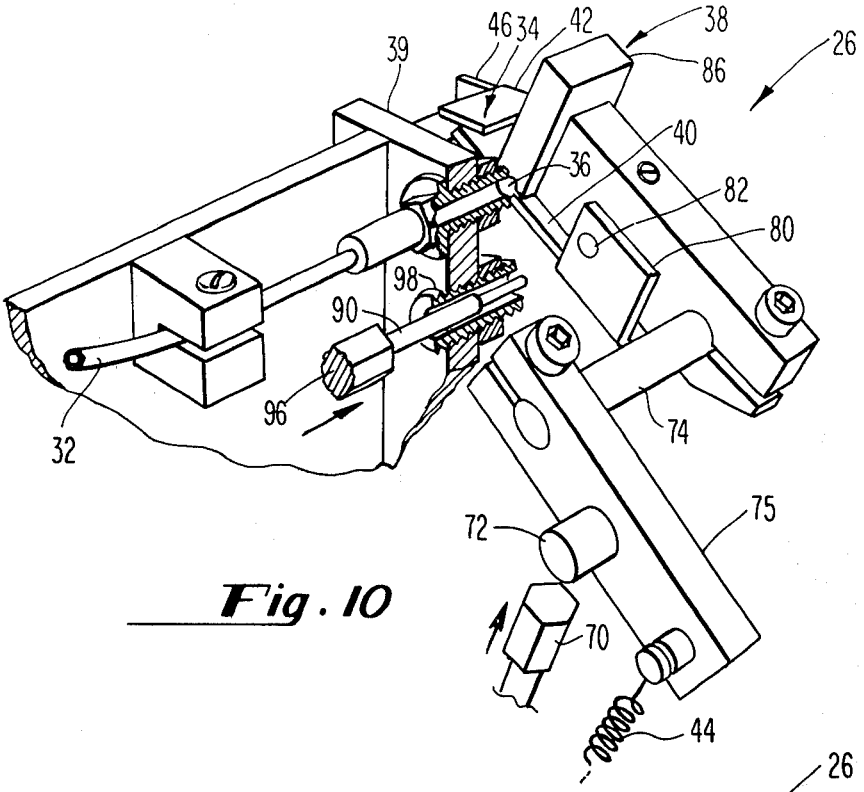
FIG. 10 is an enlarged fragmentary perspective view of the bur blank loading station of said machine, shown partly in section.

Next, the blank dental bur workpiece positioning cylinder 68 shown in FIGS. 2–4 is energized and extends the workpiece positioning cylinder pusher rod 70, as also illustrated in FIG. 10, which engages the stop block pusher pin 72 and thereby rotatably positions the loading station stop block assembly 38 from the bur blank load staging position 34, as illustrated in FIGS. 3 and 10, pivotally about the stop block mounting shaft 74 by means of the stop block assembly connecting arm 75 operating against restraining force of the stop block tension spring 44, to a pivotally deflected position as limited by pin 76 for the stop block assembly connecting arm, see FIG. 5, such position being the bur blank collet feeding position 77 as respectively also illustrated in FIGS. 2, 6 and 7, so that the blank dental bur workpiece 24 is clampably retained in the stop block feed slot 36 by means of the clamping arm 40 which is longitudinally aligned with the collet opening 78, see FIG. 7, for feeding of said blank dental bur head workpiece 24 to the collet clamping jaws 56.

It should be noted that as the loading station stop block assembly 38 is pivotally relocated from the bur blank staging position 34 to the bur blank collet feeding position 77, as illustrated respectively in FIGS. 3 and 5, the stop block clamping arm 40 is likewise retracted from bar member 42, against the action of tension spring 44, and said clamping arm 40, which is connected to the stop block clamping arm bracket 80, pivotally rotates about pin 82 against the compressive force created by the spring 84 acting against clamping arm 40, whereby the blank dental bur workpiece 24 positioned in the stop block feed slot 36 is clampably secured within said stop block feed slot 36 during pivotal relocation of the loading station stop block assembly 38 from the staging position 34 to the feeding position 77, see FIG. 7, for feeding of a blank dental bur head workpiece 24 to the collet clamping jaws 56 of a workhead assembly 22 located at Station 1.

Figure 8:
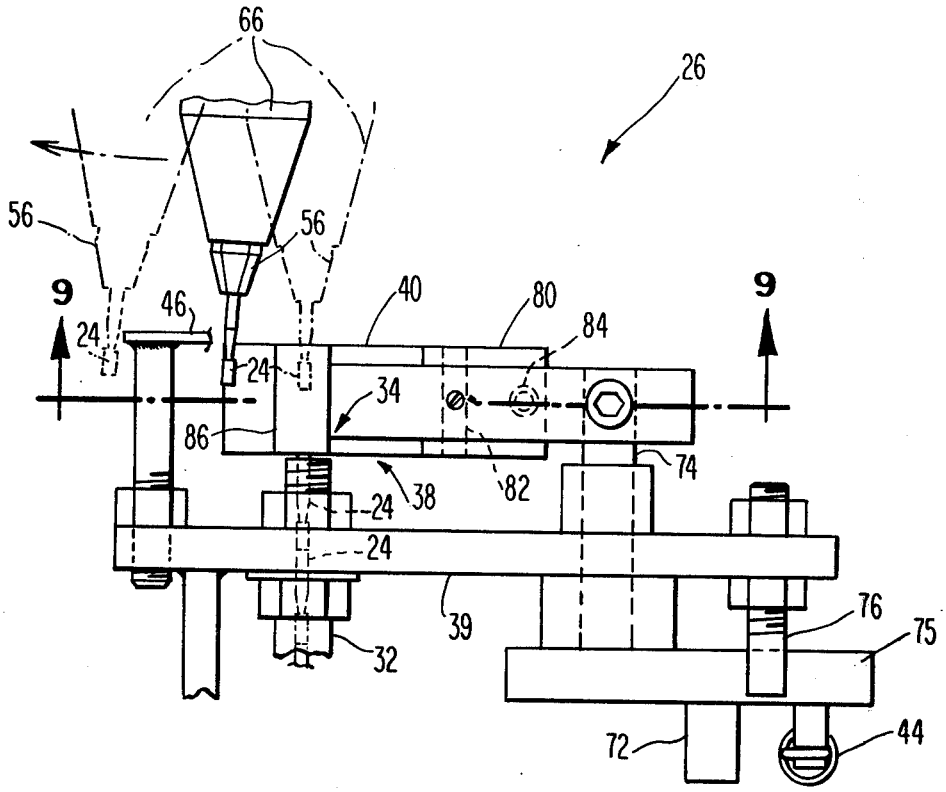
FIG. 8 is an enlarged fragmentary plan view showing the indexical removal of a collet loaded bur blank workpiece from the bur blank loading station feed slot.

It should further be noted that as the stop block assembly head 86 of the loading station stop block assembly 38 is deflected downwardly during pivotal relocation of said stop block assembly 38 for feeding a blank dental bur workpiece to the collet clamping jaws 56 of a workhead assembly 86, as respectively illustrated in FIGS. 6 and 8, slidably engages the butt end of the shank of the leading blank dental bur workpiece 24, located for transfer from the bur blank loading station feed tube 32 to the stop block feed slot 36, thereby retaining said leading blank dental bur head workpiece within said bur blank loading station feed tube 32 at the bur blank load staging position 34 for subsequent delivery to said stop block feed slot 36 during the next feeding cycle of a blank dental bur head workpiece 24 to the collet clamping jaws 56 of a workhead assembly 22.

Figure 11:
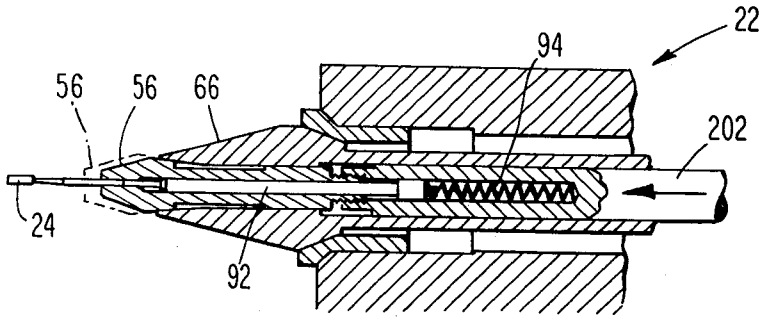
FIG. 11 is an enlarged fragmentary side sectional view of the workhead assembly collet clamping means of said machine as shown in FIG. 2.

Feeding of a blank dental bur workpiece 24 to the collet clamping jaws 56 of a workhead assembly 22, as respectively illustrated in FIGS. 7 and 11, is accomplished by energizing the bur blank workpiece feed cylinder 88, illustrated in FIG. 2, whereupon the bur blank workpiece feed cylinder pusher rod 90, respectively illustrated in FIGS. 6 and 7, is extended to engage said blank dental bur workpiece 24, positioned and clampably secured at the bur blank collet feeding position 77 by the stop block feed slot clamping arm 40 within the stop block feed slot 36 under compressive spring force created by the compression spring 84, and slidably pushes the blank dental bur workpiece 24 forward from clampable engagement within said stop block feed slot 36 so that the butt end of the shank of said blank dental bur workpiece 24 which is being fed to the collet opening 78 of the workhead assembly 22 located at Station (1), engages the face of the collet ejector rod 92 and further pushes the shank of said dental bur head workpiece forward within the collet opening 78, see FIG. 7, against the compressive spring force of the collet ejector spring 94 until collar 96 of the bur blank workpiece feed cylinder pusher rod engages adjustable stop 98 in mounting plate 39, as shown in FIG. 7.

WORKHEAD DETAILS

Figure 12:
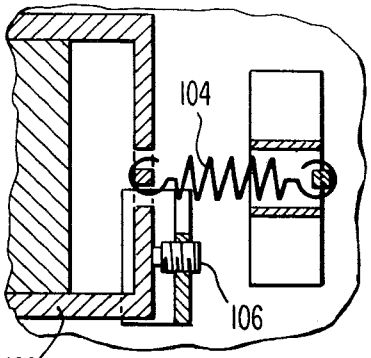
FIG. 12 is an enlarged fragmentary top sectional view of the base mounted rear stop means for a workhead assembly of said machine as seen along the line 12—12 of FIG. 2.

In order to obtain accurate registered depth of linear insertion of a blank dental bur workpiece 24 within the collet opening 78 of a workhead assembly 22, the following registration means function in combination:

Initially, as heretofore described, rotational registration of a workhead assembly 22 relative to the bur blank loading station 26, as well as other operational stations, is accomplished by the station-indexing lock pawl 48 of the indexing lock station 20 engaging the respective indexing lock stop 18 after clockwise indexing of the indexing table 14 upon which the workhead assemblies 22 are radially affixed. However, longitudinal registration of a workhead assembly 22 relative to the bur blank loading station 26, as well as other operational stations, is accomplished by means of a face cam 102, see FIG. 2, fixed to each workhead assembly, which slidably engages an accurately positioned face cam follower 100, which is located and affixed to the supporting frame structure 12 of machine 10 only at loading Station (1), whereby said face cam 102 on each workhead assembly engageably operates against the face cam follower 100 in opposition to the spring force exerted by the tension spring 104 at the rear of each workhead assembly to accurately position the workhead assemblies 22 against the adjustable stop screw 106 at Stations (2), (3) and (4) to locate each workhead assembly with regard to the cam roller follower being positioned accurately against the barrel cam at said stations, as described in detail hereinafter. Greater details of the workhead assembly stop screw 106 and the compression spring connection means are shown in FIG. 12. Workhead assembly base 108 abuts stop screw 106 at said aforementioned stations.

Thus, with each workhead assembly 22 being rotationally and longitudinally secured in registered position by means heretofore described, it is possible to rely upon the bur blank workpiece feed cylinder pusher rod 90 to obtain mechanically duplicative uniform accurate registered depth of linear insertion of a blank dental bur workpiece 24 within the collet opening 78 of a workhead assembly 22 by means of pushing the shank of said workpiece 24 into abutting contact with the face of the collet ejector rod 92, against compressive force of the collet ejector spring 94, to a depth of insertion within the collet opening 78 as determined by the adjustably set distance relation between the bur blank workpiece feed cylinder pusher rod collar 96 and the adjustable collar stop 98, relative to the linear dimension of the bur blank workpiece pusher rod 90 shown in FIGS. 6, 7 and 10.

Upon completion of the delivery of a blank dental bur workpiece 24 to the collet opening 78 of the workhead assembly 22, the pancake cylinder 58 is de-energized, thus, retracting the pancake cylinder plunger rod 60, whereupon the collet pusher rod spring 64 expands and extends the collet pusher rod 62 rearward, thus also retracting the axially outward sprung collet clamping jaws 56 which are affixed to said collet pusher rod 62, within the collet clamping jaw housing 66. This causes said collet clamping jaws 56 to axially deflect inwardly, thereby clampably engaging and securely holding the shank portion of the blank dental bur workpiece 24 which has been positioned within the collet opening 78. The collet clamping sequence for engaging and holding the shank of a blank dental bur workpiece 24 by a workhead assembly 22, as heretofore described, is illustrated in FIG. 11.

Figure 9:
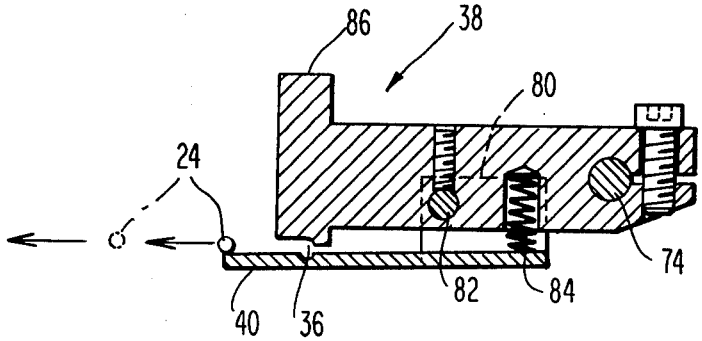
FIG. 9 is an enlarged fragmentary front sectional view the indexical removal of a bur blank workpiece from the loading station feed slot as seen along the line 9—9 of FIG. 8.

Sequentially, the bur blank feeding cycle is further completed with de-energizing of the blank dental bur head workpiece positioning cylinder 68 and retraction of the workpiece positioning cylinder pusher rod 70, de-energizing of the bur blank workpiece feed cylinder 88 and retraction of the bur blank feed cylinder pusher rod 90, de-energizing of the indexing lock station hydraulic cylinder 54 and retraction of the indexing lock station pawl 48 from engagement with the respective indexing lock stop 18. Initiation of a clockwise indexing cycle of the machine indexing table 14 then occurs by means of the Geneva gear drive 16 so that the subject workhead assembly 22, which has a blank dental bur workpiece 24 registerably secured within the collet clamping jaws 56 thereof, is rotatably advanced in an arcuate clockwise direction, thereby also arcuately disengaging said workpiece 24 from clampable engagement within the stop block feed slot 36 by deflecting the stop block feed slot clamping arm 40 downwardly while being indexically advanced in an arcuate clockwise direction, as respectively illustrated in FIGS. 8 and 9. This also enables the loading station stop block assembly 38 to be pivotally returned, through means of retractive spring force created by the stop block tension spring 44 which is affixed to the stop block assembly connecting arm 75, from the bur blank collet feeding position 77 to the bur blank load staging position 34 for the positioning of another blank dental bur head workpiece 24 within the stop block feed slot 36 as earlier described.

Upon completion of the heretofore mentioned indexing cycle the subject workhead assembly 22 is indexically relocated in locked registered position at the Station (2) grinding station 28 location to perform subsequent simultaneous helically configured groove cutting operations upon the longitudinal circumferential side face of the subject blank dental bur workpiece 24, which helically configured groove cutting operations are accomplished automatically and concurrently during the subsequent indexing stop feeding of yet another blank dental bur workpiece 24 to the indexically advanced workhead assembly 22, which has been relocated to the Station (1) location from the Station (4) location during the arcuate indexing cycle by the Geneva gear-driven mechanism in clockwise direction.

The automatic pre-timed indexing stops of the workhead assembly 22 on indexing table 14 at the bur blank loading station 26, as are all other subsequent indexing stops of machine 10, which are electronically sensed by input signals to the control panel, are of sufficient duration to enable the control panel-sensed sequential blank bur head workpiece delivery and feeding functions of the bur blank loading station 26 to be completed, while at the same time being also of sufficient duration to enable the automatic accomplishment and completion of the next succeeding sequential bur grinding functions which are concurrently carried out at operational machine Stations (2) through (4), inclusive, during the subsequent automatic indexing stops and successive bur blank feeding and loading cycle operations at Station (1) location of machine 10, as heretofore described.

GRINDING STATIONS NOS. (2) AND (3)

Figure 32A:
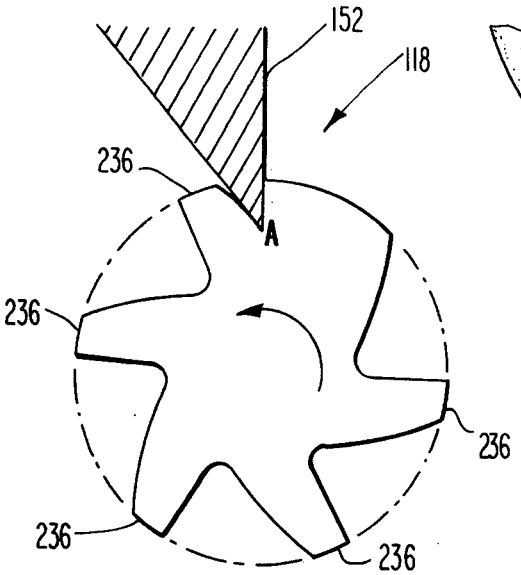
FIG. 32*a* is an enlarged end elevation taken at the depth of grinding wheel bur head cut position A as seen along line 32*a*—32*a* of FIG. 32.
Figure 32:
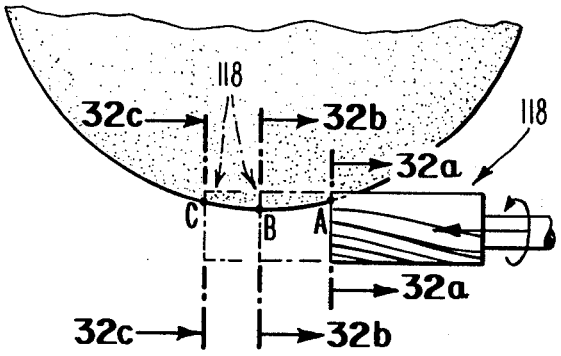
FIG. 32 is a schematic side elevation of an exemplary in-process bur head depicting the side tooth bur head groove cut operation accomplished by the groove cut grinding wheel station of said machine.
Figure 32B:
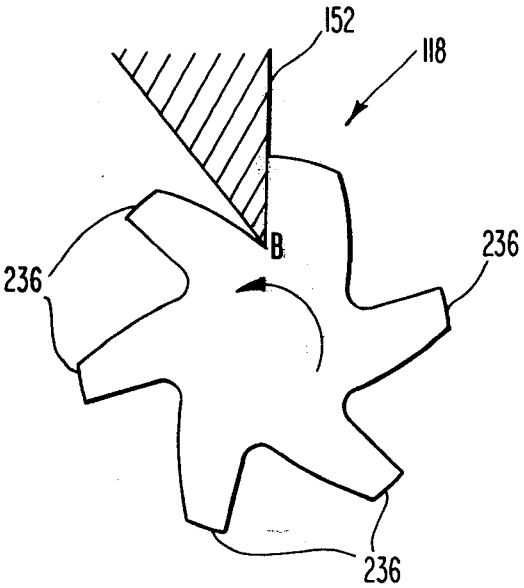
FIG. 32*b* is an enlarged end elevation taken at the depth of grinding wheel bur head cut position B as seen along line 32*b*—32*b* of FIG. 32.
Figure 32C:
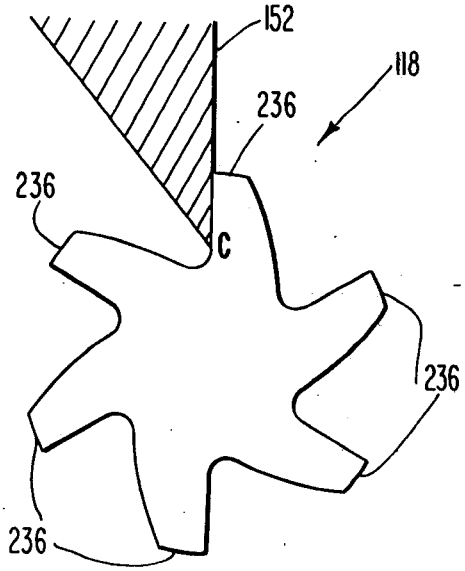
FIG. 32*c* is an enlarged end elevation taken at the depth of grinding wheel bur head cut position C as seen along line 32*c*—32*c* of FIG. 32.

The bur head grinding function which is carried out upon bur blank 118 at Station (2) which is referred to as the groove cut operation, is sequentially shown in the FIG. 32 and corresponding sectional views of the same as seen in FIGS. 32*a* through 32*c*, inclusive. However, prior to describing the groove cutting functions of the machine 10 at Station (2) thereof, it should be noted that, except for the peripheral grinding wheel cutting profiles and the consequent nature of the resultant helically configured longitudinal circumferential side face bur head cuts respectively accomplished at Stations (2) and (3), the mechanical and operational characteristics of the machine at Stations (2) and (3) are essentially identical. Therefore, it will be understood that the basic essence of the detailed mechanical and operational description of the machine for Station (2) is applicable to the operation at Station (3). Also, in all grinding stations, the grinding wheels are mounted upon a shaft which has a driven pulley thereon operated by a belt driven by another pulley on the shaft of an electric motor carried by a vertically movable head movable in guides at the various stations.

Figure 13:
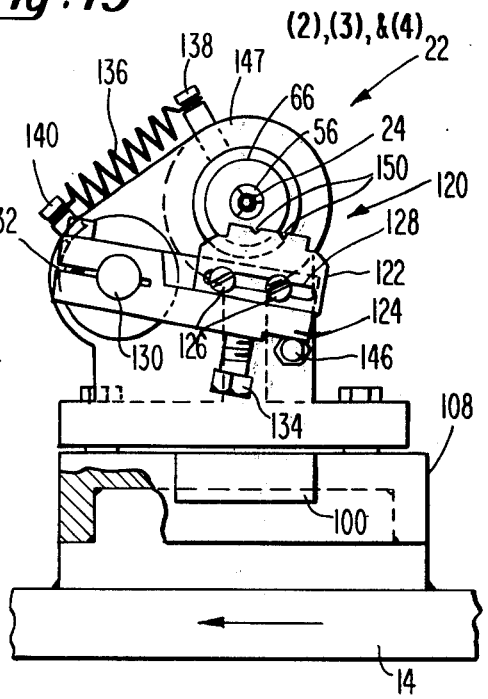
FIG. 13 is an enlarged fragmentary front elevation of a workhead assembly and the steady rest sub-assembly thereof, shown as the same would appear during an indexing cycle transition between operational stations of said machine, as at 13—13 of FIG. 2.

Referring now to FIG. 13, which is a fragmentary enlarged front elevation of a workhead assembly 22 as the same would appear in FIG. 1 during the previously described arcuate clockwise indexing cycle movement between Station (1) and Station (2) of machine 10, wherein is particularly shown the pivotally mounted steady rest sub-assembly 120 of a workhead assembly 22, said steady rest sub-assembly mechanically operates to support the neck of the shank of a blank dental bur workpiece 24, or subsequently the neck of the shank of an in-process bur head workpiece 118, during grinding operations. The steady rest sub-assembly 120 is comprised of a laterally adjustable steady rest support plate 122 which is firmly secured to the steady rest support arm 124 by means of a pair of screws 126, said screws 126 being inserted through slot 128 of the steady rest support plate 122 to permit adjustment of plate 122, and thereafter being tightened into threaded holes in steady rest support arm 124, against plate 122.

The steady rest support arm 124 is adjustably secured at one end thereof to the steady rest pivot shaft 130 by means of a bolt tightened clamping slot 132. Threadably inserted within the underside surface of arm 124 at the other end thereof is an adjustable steady rest cam engageable bolt 134. During the feeding and indexing of the blank dental bur workpieces 24 between operational stations, the steady rest sub-assembly 120 is retained in a lowered inoperative position by means of tension spring 136 which is connected between pin 138 and the pivot shaft set bolt 140. Bolt 140 not only holds the spring 136 under tension, but it also is the means to lock the collar 142 to pivot shaft 130 to transmit the tension of spring 136 to shaft 130.

Steady rest stop pin 146 engages and retains the steady rest sub-assembly 120 in its lowered inoperative position during the feeding and indexing cycle movement of blank bur workpieces between operational stations. As the indexing table 14 and the subject workhead assembly 22 mounted thereon, with the steady rest sub-assembly 120 positioned thereon in the lowered inoperative position, moves in arcuate clockwise direction from Station (1) and approaches Station (2), the face of bolt 134 of the steady rest assembly cam 148 and elevates the steady rest sub-assembly 120 about the axis of shaft 130. Such movement is against the tension of steady rest spring 136 and thereby causes one of the steady rest shank-supporting grooves 150 in plate 122 to be pivotally brought into supporting contact with the neck of the shank of the subject blank dental bur workpiece 24 and mechanically supports the same during the automatic grinding of helically configured longitudinal grooves therein by the grinding operations at Station (2) of grinding wheel 152. Cam 148 is fixed to a pedestal 149 supported by indexing table 14 at Stations (2), (3) and (4).

Upon completion of the aforementioned positioning of the steady rest support plate groove 150 at Station (2) to provide mechanical support for the subject blank dental bur workpiece 24 during grinding operations, as well as laterally cammed positioning of said workpiece 24 by engagement of the face cam 102 of workhead assembly 22 with face cam follower 100 at Station (2), the indexing lock pawl 48 engages the next respective indexing lock stop 18 of table 14 and input signals to the control panel initiate the grinding sequence at Station (2), as well as initiating, as heretofore described, another feeding cycle of a blank dental bur workpiece 24 at Station (1). The above-described operative arrangement at Station (2) is illustrated in perspective in FIG. 15.

Figure 15:
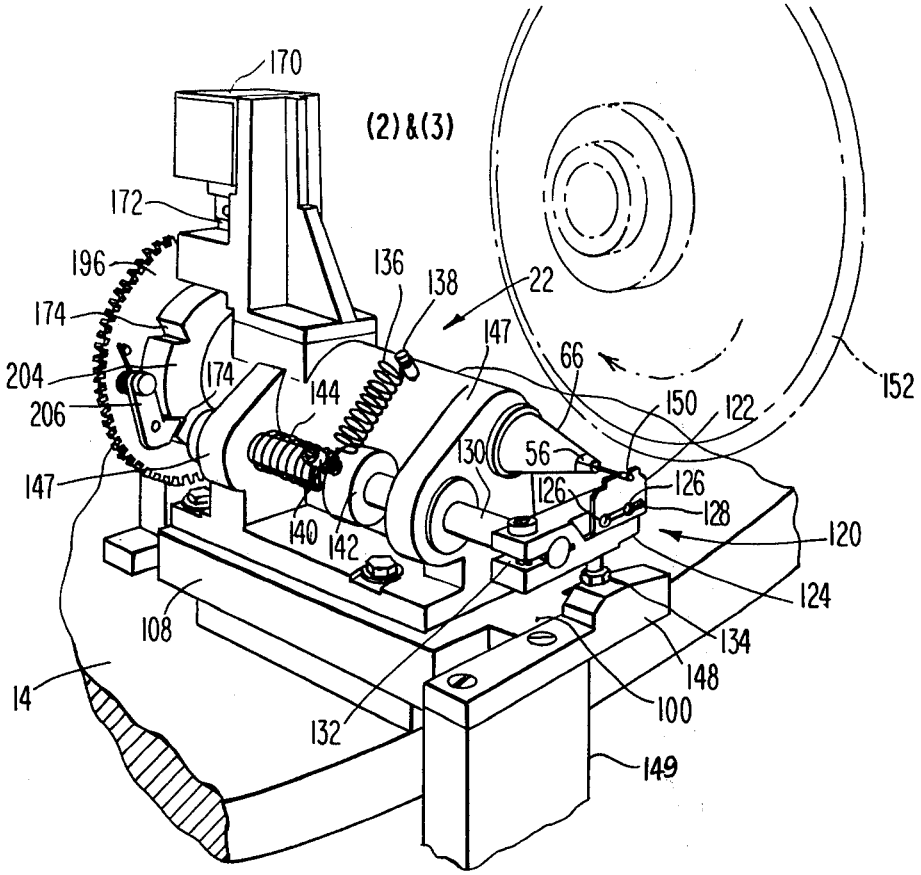
FIG. 15 is a perspective view of the workhead assembly in position at an operational station of said machine.
Figure 14:
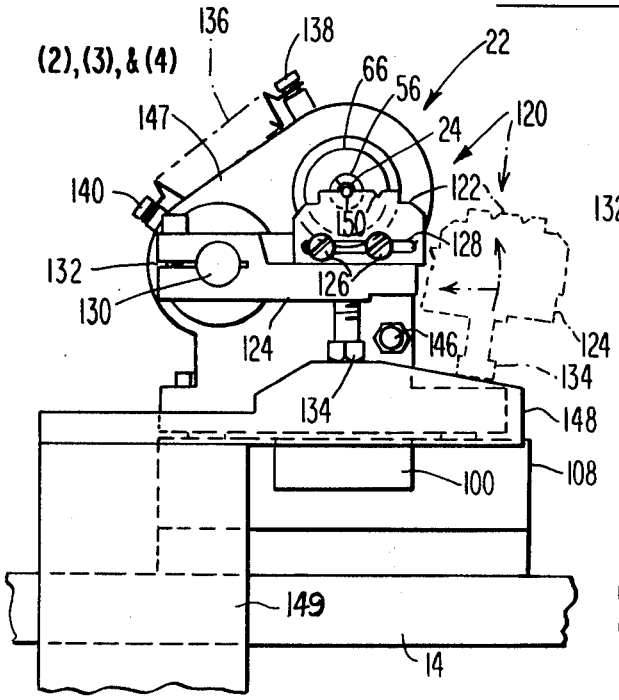
FIG. 14 is a view similar to FIG. 13, but showing the steady rest sub-assembly of the workhead assembly cammed into bur blank supporting position at an operational station of said machine.

In FIG. 15, there also is shown a compression spring 144, which surrounds shaft 130 of the workhead assemblies 22 and to which the steady rest assembly 120 of each workhead 22 is connected. Said spring extends between the flange 147 through which shaft 130 extends and collar 142 which is anchored to shaft 130. Spring 144 is operable to prevent rearward axial movement of shaft 130 when the workhead assemblies are cammed forwardly at Stations (2), (3), and (4) by the operation of the barrel cam 198, described in detail hereinafter. This is essential to prevent axial movement of the steady rest support plate 122 relative to the necks of the burs which they engage to support the same against downward deflection.

Figure 16:
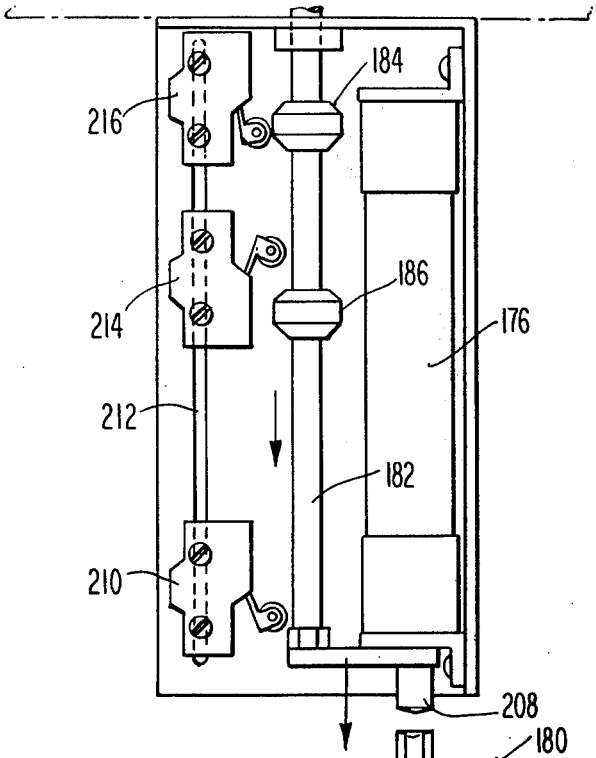
FIG. 16 is an enlarged sectional elevation of the workhead assembly bur head feed drive means and associated control switches as seen along the line 16—16 of FIG. 1.
Figure 16:
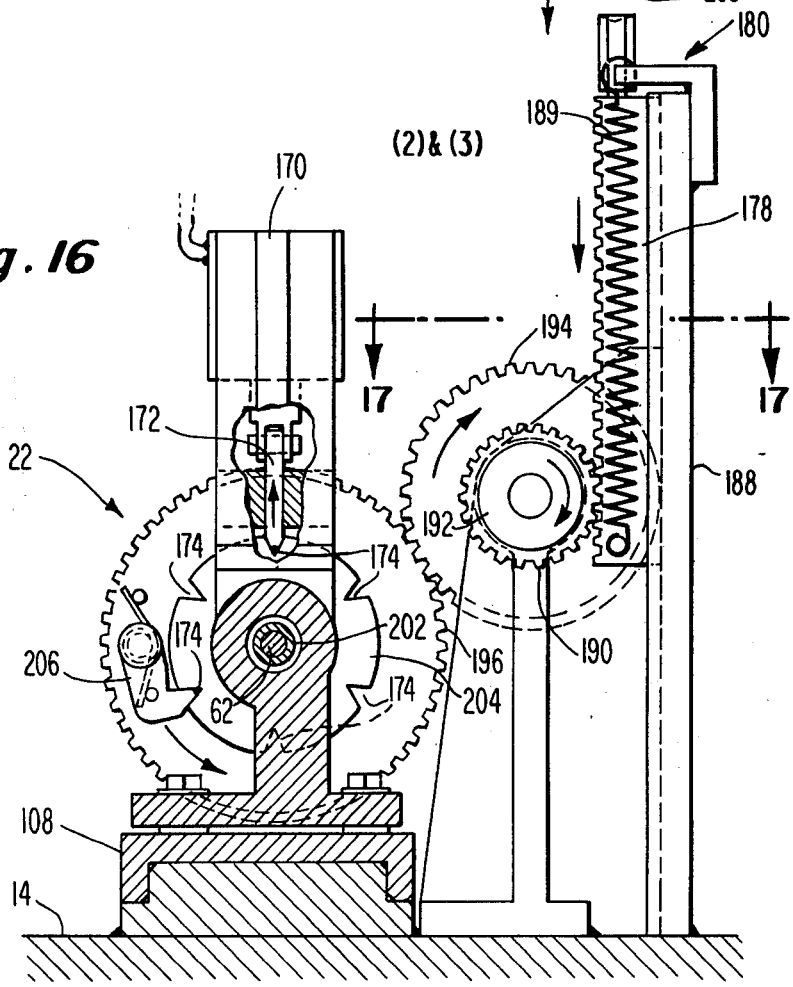
Figure 18:
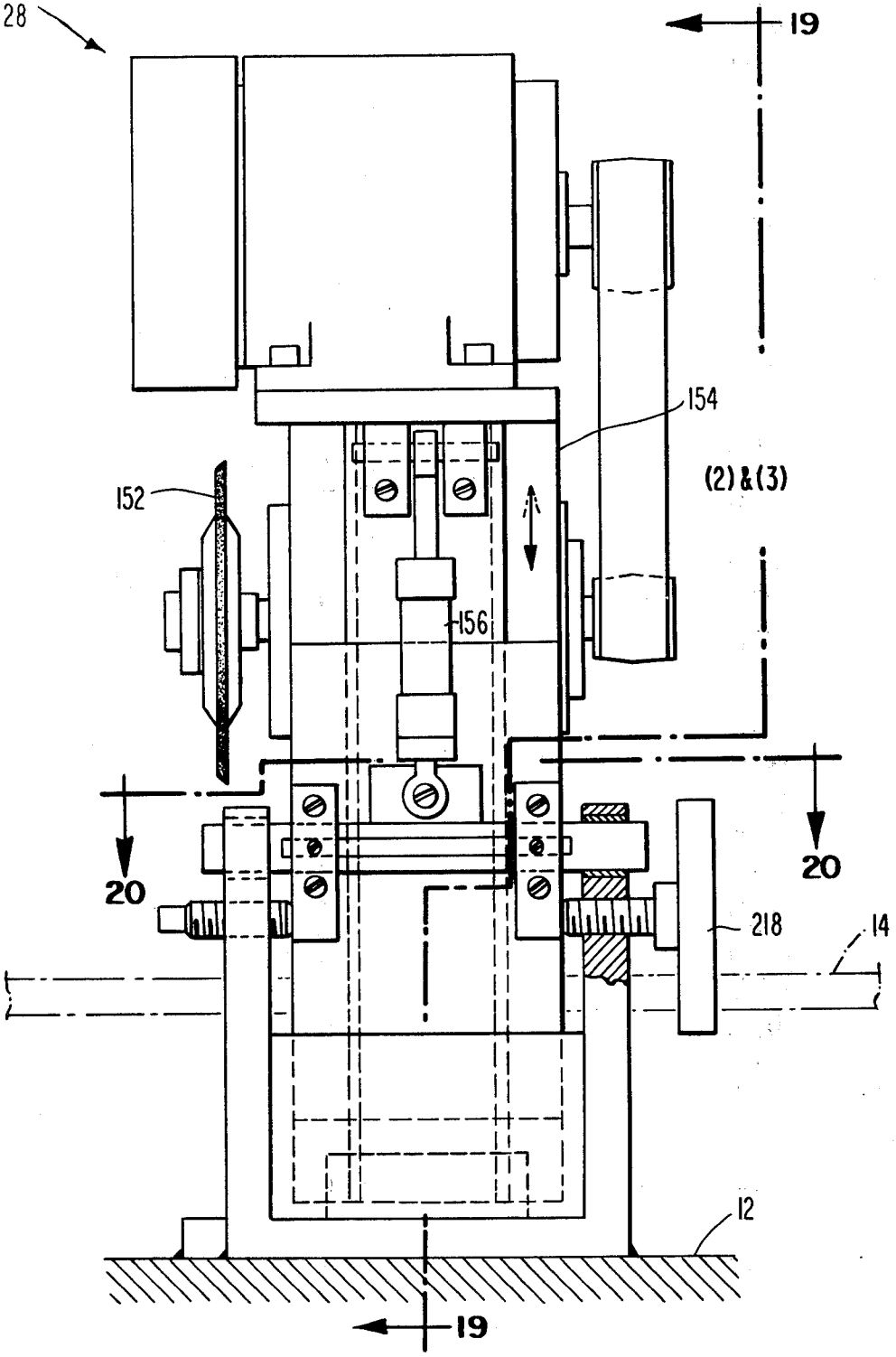
FIG. 18 is an enlarged rear elevation of a side tooth bur head grinding station of said machine as seen along the line 18—18 of FIG. 1.
Figure 19:
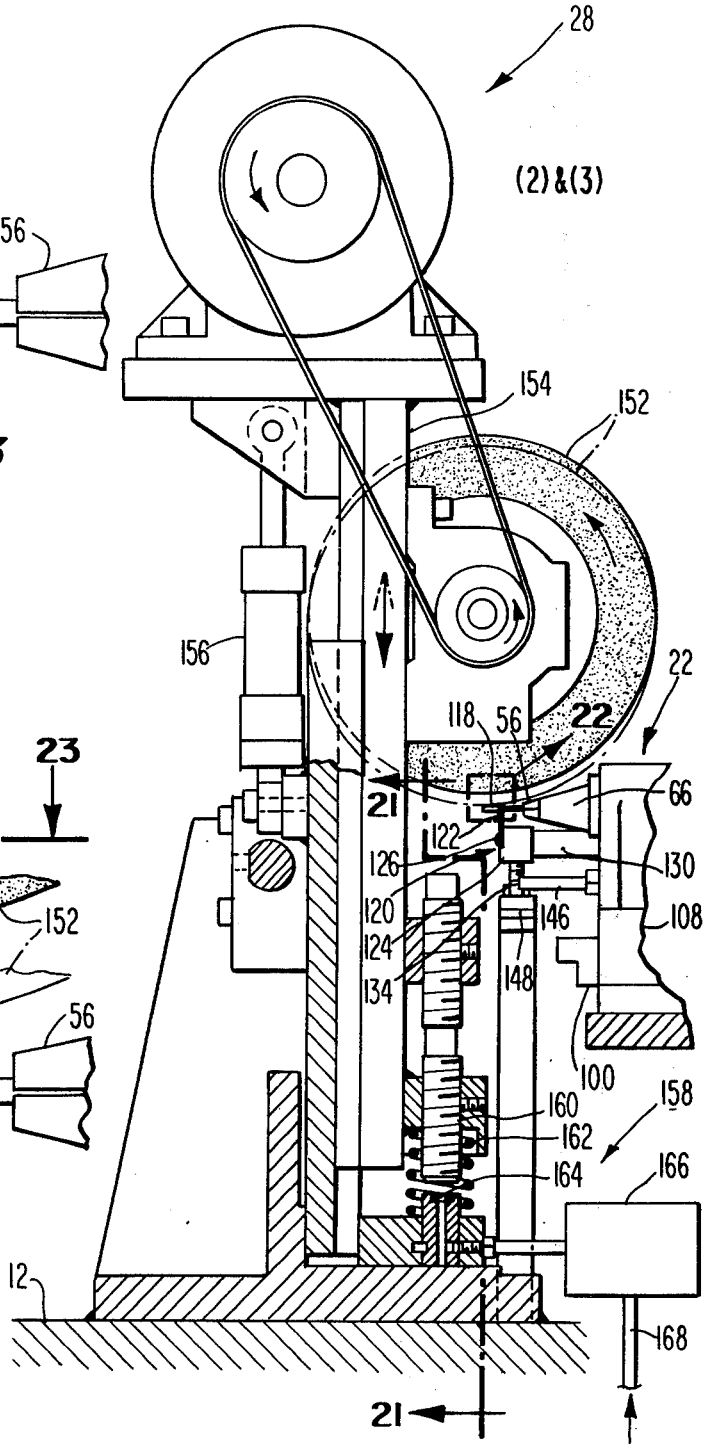
FIG. 19 is a side sectional elevation of a side tooth bur head grinding station of said machine as seen along the line 19—19 of FIG. 18.

Reference is again made to FIGS. 32 and 32*a* through 32*c*, while at the same time referring also to FIG. 16 and certain of the other subsequent Figures, to explain and describe the sequential nature of forming helically configured side surface groove cuts in a blank dental bur workpiece, as well as additionally explaining and describing the control and mechanical sequential operational functions accomplished at Station (2) in making said helically configured side surface groove cuts. Initially, in groove cutting sequence at Station (2) the bur head groove cutting grinding wheel 152, which is rotatably carried by the vertically movable grinding head assembly plate 154, as shown in FIGS. 18 and 19, is lowered automatically upon a preprogrammed control panel signal being given. Such lowering is effected by means of energizing the hydraulic grinding head cylinder 156 which also is illustrated in FIGS. 18 and 19, which moves the assembly plate and grinding wheel 152 to a predetermined adjustable position which establishes the depth of the bur head groove cuts. However, said grinding wheel 152 does not grindably engage the subject blank dental bur head workpiece 24 until said workpiece 24, as will hereinafter be described, is fed forward while also being rotated for accomplishing the helically configured groove cutting operation.

The input signal to the control panel for initiating the drive train which rotationally feeds the blank dental bur workpiece 24 forward into grindable engagement with the cyclically positioned rotatable grinding wheel 152 is transmitted by closing of air switch 158, illustrated in FIG. 19. Operation of air switch 158 is simultaneously accomplished upon automatic preprogrammed lowering of the vertically movable plate 154 for the grinding wheel assembly and to which is also affixed the vertically adjustable air switch orifice plug 160 which moves downwardly against the upwardly directed force of air switch compression spring 162 and thereby closes the air switch orifice 164 to initiate activation of the air switch 158.

The amount of air pressure required to activate the air switch 158 for transmission of an input signal to the control panel to initiate the rotational forward feeding of a blank bur workpiece is set by means of the air switch regulator 166, which is generally in the range of 50 to 60 psi, although not necessarily being restricted to the aforementioned pressure range. Further, the pressure at which the air switch is set to be activated is primarily determined by the line pressure of house air available at the air switch regulator 166, as provided through the air supply line 168. Upon the buildup of air switch pressure to an amount which is equal to that of the input line air pressure, a signal is then transmitted to the control panel to initiate the rotational forward feeding of the workpiece drive train. It should be noted that an air switch is particularly suitable in the aforementioned application in that the features thereof include: (1) self-cleaning of the contact interface by air escaping from the orifice when the air switch orifice plug is in the open position, (2) engagement of the air switch orifice plug with the head of the air switch orifice provides a positive stop which, in turn, enables close tolerance control in setting and maintaining uniform groove cut depth, and (3) the setting to activate the air switch may be changed or adjusted without changing the switch itself.

The formation of the groove cut configuration of the bur head, as illustrated in FIG. 32, and the corresponding sectional illustrations shown in FIGS. 32*a* through 32*c*, inclusive, is accomplished by rotationally feeding the bur head forward into cutting engagement with the grinding wheel 152, as is sequentially illustrated in FIG. 32. Initial cutting engagement of the grinding wheel 152 with an in-process bur head workpiece 118 is as illustrated in the enlarged sectional view shown in FIG. 32*a*, and as the bur head is rotationally fed forward in cutting engagement with the grinding wheel 152, a helically configured grooved body is progressively formed along the longitudinal circumferential dimension of the in-process bur head workpiece 118 as is sequentially illustrated in the additional sectional views shown in FIGS. 32*b* and 32*c*, to form the generated groove therein shown.

Operationally, Station (2) accomplishes the grinding of a groove by rotational and forward feeding of a bur head in the following manner. Upon transmission of an air switch signal to the control panel indicating that the bur head grinding wheel 152 for cutting a groove is in the lowered cutting position, the workhead assembly solenoid 170, shown in FIG. 16, is energized and retracts the locking dog 172 of the barrel cam drive collar from locking engagement with the respective V-slot 174 of the barrel cam collar while simultaneously, the barrel cam rack gear drive cylinder 176, also illustrated in FIG. 16, is energized to extend the piston thereof to engage the rack gear 178 of the barrel cam drive train gear assembly 180. Also extended with the drive cylinder piston for the rack gear is the grinding station control switch cam rod 182, upon which are mounted the upper switch cam 184 and the lower switch cam 186, both of which cams are set to activate operational function switches during forward rotational feeding of a bur head workpiece.

Figure 17:
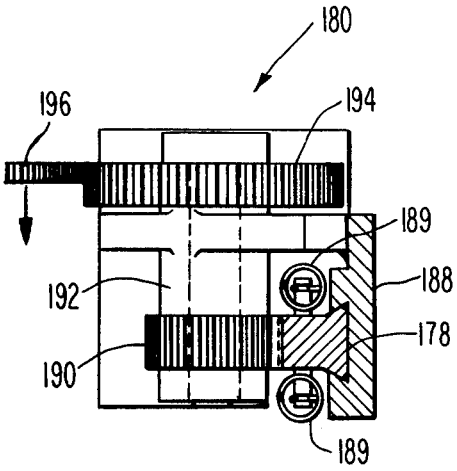
FIG. 17 is a top sectional view of the workhead assembly bur head feed drive means as seen along the line 17—17 of FIG. 16.

The drive train gear assembly for the barrel cam is comprised of the aforementioned rack gear 178, which is slidable upon and along support post 188, and a set of rack gear return springs 189 are affixed to the opposite lateral sides thereof to provide means to return the rack gear to the upper position thereof upon the completion of a forward drive cycle and retraction of the rack gear drive cylinder piston 208. The rack gear 178 engages circular gear 190 which is connected by shaft 192 to the barrel cam drive gear 194 which, in turn, engages the barrel cam driven gear 196, all of which is illustrated in FIG. 16 and the fragmentary enlarged top plan sectional view in FIG. 17. As the drive train gear assembly 180 for the barrel cam 198 is activated in a forward driven motion by movement of piston 208 of the barrel cam drive cylinder 176 in the manner heretofore explained, the barrel cam 198 of the workhead assembly 22 engages the stationary axially rotatable barrel cam roller follower 200, shown in FIG. 2, and thereby rotatably moves the workhead spindle 202 which supports the collet clamping jaw housing 66 and the blank dental bur workpiece 24 clamped therewith by collet clamping jaws 56, forwardly and moves said workpiece 24 axially into grindable cutting engagement with the grinding wheel 152 to sequentially form a helical groove cut as illustrated in FIG. 32 and the corresponding enlarged sectional views as shown in FIGS. 32*a* through 32*c*, inclusive, as heretofore explained.

It should be noted that as the workhead spindle 202 is rotationally fed forward by the axial and rotatable motion of barrel cam 198, the barrel cam drive collar 204 is locked to the driven gear 196 on the barrel cam 198 to translate the axial and rotatable movement thereof to said workhead spindle 202 by means of the spring loaded pawl 206 to gear 196 by movement of the piston of the rack gear drive cylinder 176, lockably engages one of he V-slots 174 of barrel cam collar 204, as illustrated in FIGS. 15 and 16.

The sequence of the bur head groove cut grinding cycle is sensed by a series of switches activated by the upper switch cam 184 and lower switch cam 186 which are adjustably mounted upon the reciprocally moving cam rod 182 which, in turn, is affixed to piston 208 of the barrel cam rack gear drive cylinder, all of which is illustrated in FIG. 16. During downward movement of the control switch cam rod 182, after the workhead assembly solenoid 170 has been energized and withdrawn locking dog 172 from lockable engagement with the respective V-slot 174 barrel cam locking collar, and there is a simultaneous input signal transmitted to the control panel to energize the drive cylinder 176 which drives rack 178 downward to produce forwarding driving motion of the drive gear assembly 180, and the spring loaded pawl 206 on barrel cam gear 196 lockably engages a respective V-slot 174 in the barrel cam drive collar 204, the barrel cam 198 is rotationally driven against the stationary barrel cam roller follower 200. This causes the workhead spindle 202 to be rotatably driven forward as the workhead assembly base 108 is locked against forward movement by means of the face cam 102 on base 108 engaging the face cam follower 100. Also, the rear of the workhead assembly base 108 is in engagement with the rear stop screw 106 on table 14.

All of the foregoing mechanically insures that the bur head face tooth cuts to be made at grinding Station 4 will match with the helically configured longitudinal grooves and subsequent relief cuts respectively accomplished at grinding Stations 2 and 3. Referring to FIG. 16, the bottom switch 210, activated by engagement by the lower switch cam 186, senses the end of the groove cut operation as theretofore pre-set in vertical adjustment upon the stationary workhead assembly control switch mounting bar 212 to establish the length of the groove cut. Upon the sensing of completion of the groove cut by activation of said bottom switch 210, the hydraulic grinding head cylinder 156 is de-energized, resulting in the elevation of the grinding head assembly plate 154, see FIGS. 18 and 19, upon which the groove cutting grinding wheel 152 is mounted, in addition to the barrel cam rack gear drive cylinder 176, shown in FIG. 16, being de-energized and resulting in the rack gear return springs 189 elevating the rack gear 178 while simultaneously retracting the workhead spindle 202 rotatably rearward.

When the lower switch cam 186 engages and activates the middle switch 214, the workhead assembly solenoid 170 is de-energized to cause locking dog 172 to be received in one of the V-slots 174 of the barrel cam drive collar 204, thereby initiating indexing of the in-process bur workpiece 118 for the successive cutting of the next helically configured longitudinal groove to be made by employment of the mechanical advantage exerted by the force of the rack gear return springs upon the spring loaded gear pawl 206 for the barrel cam causing said pawl 206 to ratchet out from the V-slots 174 in which it is disposed as the rack gear 178 is elevated and the workhead spindle 202 is rotatably retracted and indexes for the next successive cut as the barrel cam 198 returns to the low position.

Upon completion of the workhead assembly indexing return cycle, the top switch 216 is activated by the upper switch cam 184, which transmits an input signal to the control panel to indicate that the workhead assembly is fully retracted, and the next successive groove cut cycle is initiated as heretofore described. Thereafter, this is successively repeated until completion of the total number of grooves have been cut, as programmed by the control panel. Views showing the sequence of bur head workpiece groove cuts are illustrated in FIGS. 22 and 23, wherein is seen the retractable motion of the groove cut grinding wheel 152, as well as the forward rotational feeding of the bur head workpiece into engageable contact with the grinding wheel 152 by which the groove cuts are made.

The views shown in FIGS. 18, 19, 20 and 21 illustrate the mechanical assembly and configuration of grinding mechanisms at Station (2) and Station (3), the same showing the motor and drive means, as well as the lateral adjustment hand wheel 218.

Upon completion of the groove cutting sequence, the indexing table 14 is then indexed, as previously described, so that the subject workhead assembly 22 is relocated and registerably positioned at Station (3) for making the relief cuts by suitable grinding operations, during thich time the loading and grinding operations at Station (1) and Station (2) are automatically accomplished concurrently, as also previously described.

As earlier indicated, at Station (3), except for the profile configuration of the grinding wheel, the operation on the burs is functionally similar to that at Station (2), as mechanically and operationally described supra. It will be noted, as illustrated respectively in FIGS. 33*a* and 33*b*, that the cutting face profile of the grinding wheel 232 which makes the relief cuts is of a different configuration than that of the groove cutting grinding wheel 152, as respectively illustrated in FIGS. 32*a* through 32*c*, inclusive, and consequently, the relief cutting grinding wheel 232 accomplishes a different type of helically configured cut along the bur head than does the groove cutting grinding wheel 152. However, the locking, sensing, feeding, and functional operation of the mechanism at Station (3) is otherwise identical to that at Station (2), as heretofore described.

Figure 24:
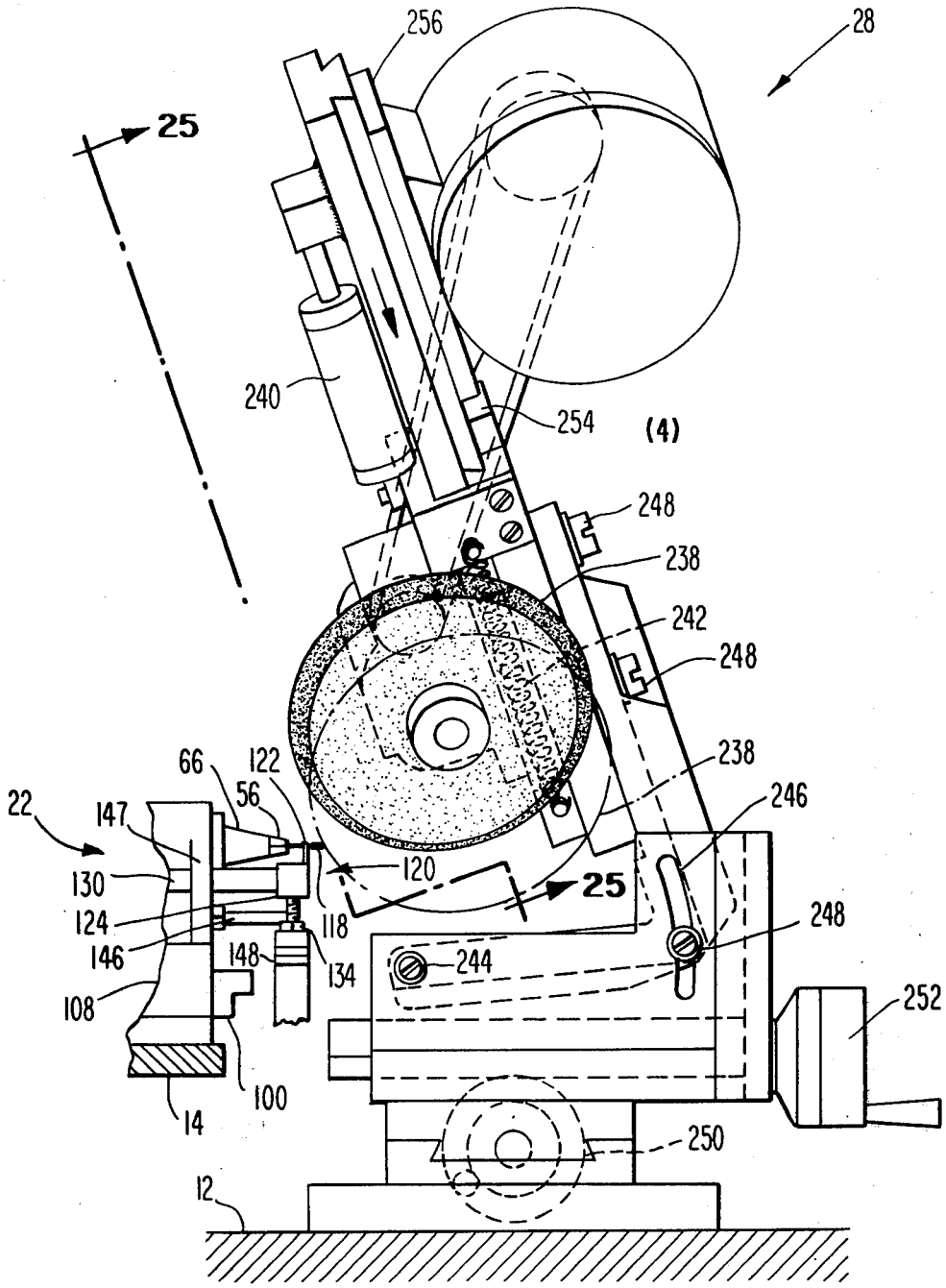
FIG. 24 is an enlarged elevation of the top tooth bur head grinding station of said machine as seen along the line 24—24 of FIG. 1.
Figure 25:
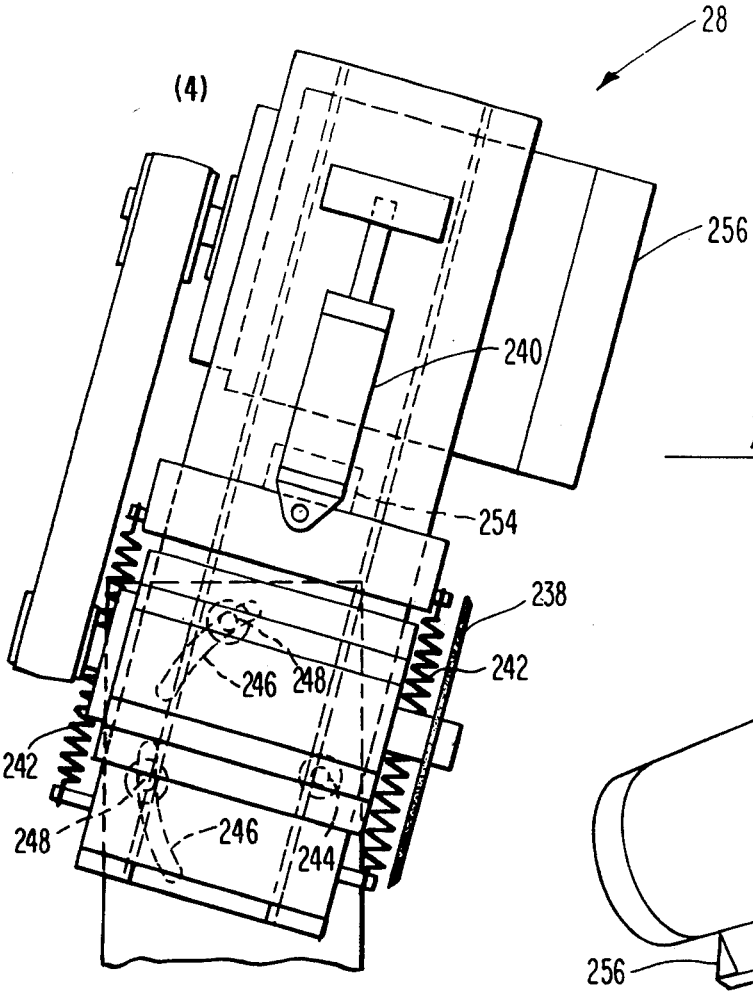
FIG. 25 is a fragmentary front elevation of the top tooth bur head grinding station of said machine as seen along the line 25—25 of FIG. 24.
Figure 26:
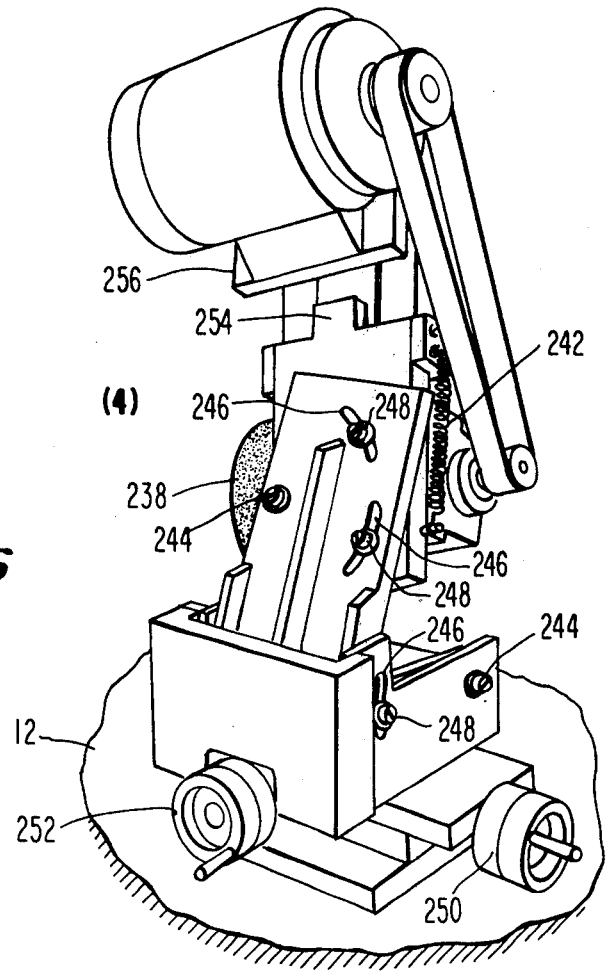
FIG. 26, is a perspective view of the top tooth bur head grinding station of said machine as seen along the line 26—25 of FIG. 1.
Figure 33A:
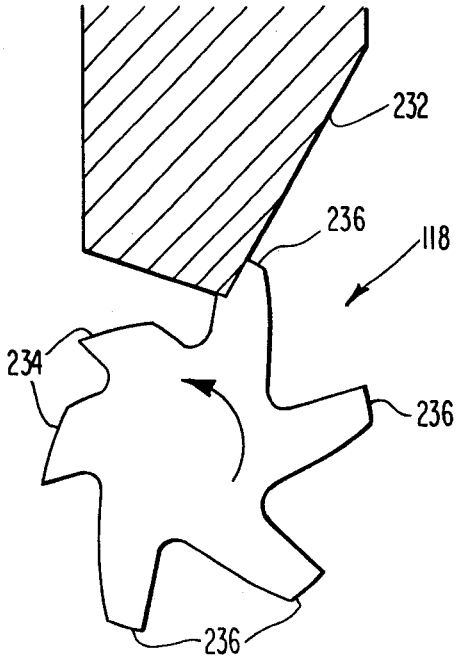
FIG. 33*a* is an enlarged end elevation of an exemplary in-process bur head, corresponding to the exemplary bur head shown in FIG. 32, depicting the beginning of a side tooth bur head relief cut operation accomplished by the relief cut grinding wheel station of said machine.
Figure 33B:
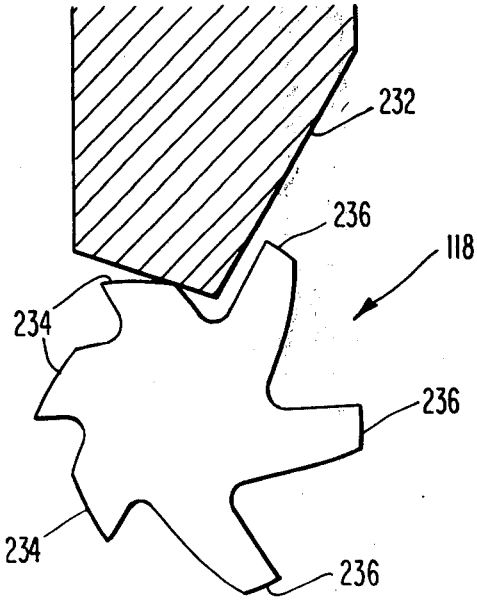
FIG. 33*b* is an enlarged end elevation of the exemplary in-process bur head shown in FIG. 33*a*, however, depicting the completion of a side tooth bur head relief cut operation accomplished by the relief cut grinding wheel station of said machine.

It will be noted, as illustrated respectively in FIGS. 33*a* and 33*b*, that the cutting operation performed by the relief cutting grinding wheel 232 forms a helically configured surface 234 by helically removing by grinding a portion of the protruding parts of the bur head shanks 236 previously formed at Station (2) groove cutting operations. The respective views of a finished straight cylindrical dental bur 30 having six helically configured teeth, as illustrated in FIGS. 29, 30 and 31, also show in part the respective helically configured relief surfaces which provide side support bodies 234 for the respective teeth to strengthen the cutting edges and flanks of the teeth. These are formed during the relief cuts made at Station (3). With the completion of the relief cutting operations at Station (3), the helically configured side face tooth cuts are all completed in the bur head and the indexing table 14 then initiates a clockwise indexing displacement cycle to lockably register the subject workhead assembly 22 in position at grinding Station (4) for top cut operations on the bur heads, as illustrated in FIG. 24 and supplemental views shown in FIGS. 25 and 26.

GRINDING STATION NO. (4)

At the outset, it should be pointed out that the primary mechanically operational distinction between functions of grinding Stations (2) and (3), and the top cut grinding Station (4), is the fact that the bur head top cut grinding wheel 238 moves to the in-process bur head workpiece rather than having said workpiece being moved to the grinding wheel as occurs at both of operational Stations (2) and (3), the mechanically operational difference at Station (4) being to maintain accuracy of the top cut.

Figure 34:
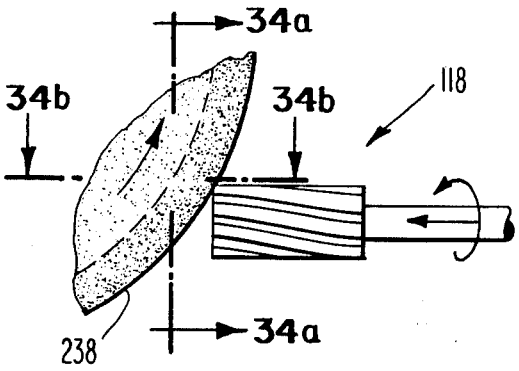
FIG. 34 is a schematic side elevation of an exemplary in-process bur head, corresponding to the exemplary bur head shown in FIG. 32, depicting the beginning of a face tooth bur head top cut operation accomplished by the top cut grinding wheel station of said machine.
Figure 35:
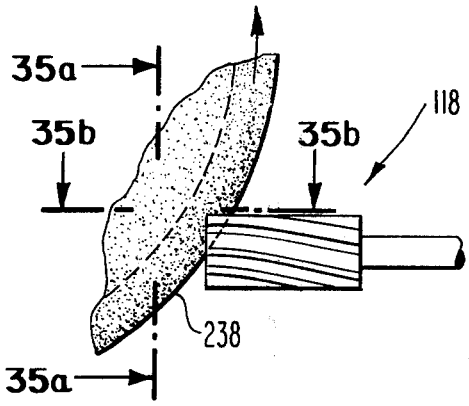
FIG. 35 is a schematic side elevation of the exemplary in-process bur head shown in FIG. 34, depicting the completion of a face tooth bur head top cut operation accomplished by the top cut grinding wheel station of said machine.
Figure 34A:
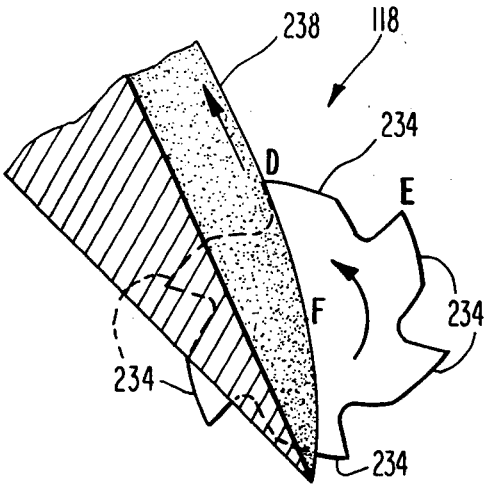
FIG. 34*a* is an enlarged fragmentary end elevation as seen along line 34*a*—34*a* of FIG. 34.
Figure 34B:
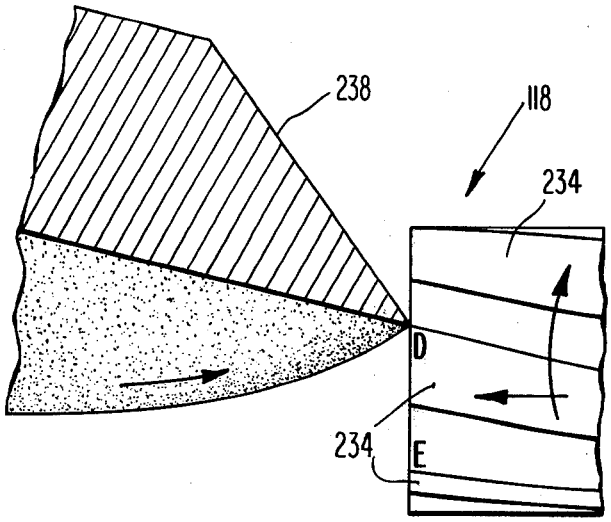
FIG. 34*b* is an enlarged fragmentary plan view as seen along the line 34*b*—34*b* of FIG. 34.
Figure 35A:
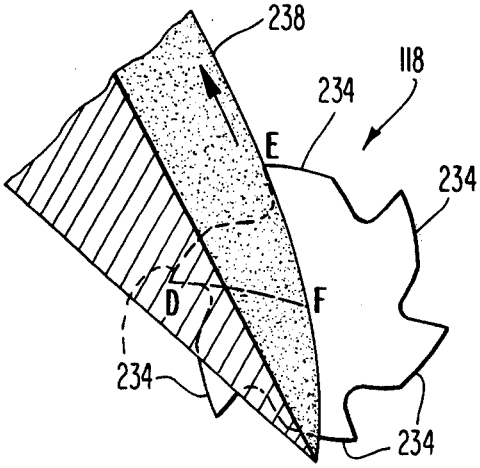
FIG. 35*a* is an enlarged fragmentary end elevation as seen along the line 35*a*—35*a* of FIG. 35.
Figure 35B:
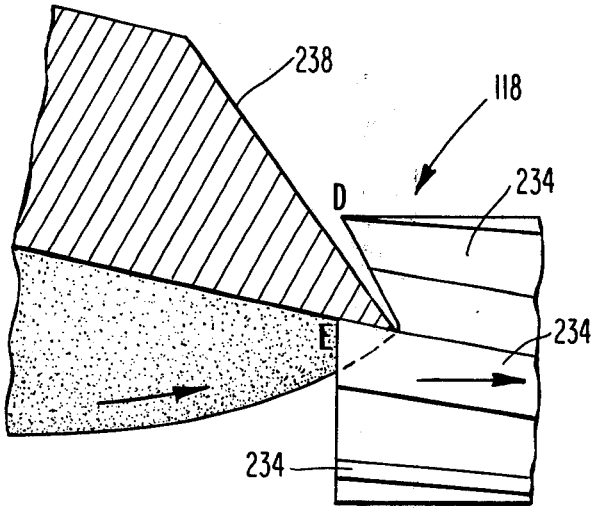
FIG. 35*b* is an enlarged fragmentary plan view as seen along the line 35*b*—35*b* of FIG. 35.

The respective illustrations shown in FIGS. 34, 34*a* and 34*b*, as well as FIGS. 35, 35*a* and 35*b*, show the progressive bur head top cut operations. Initially, the in-process bur head workpiece 118 is indexed and positioned for engageable top cut contact with the top cut grinding wheel 238. The top cut grinding wheel positioning cylinder 240 is then activated and the top cut grinding wheel 238 is lowered, against retractive spring force of the grinding head return springs 242, into engageable top cutting contact with the in-process bur head workpiece 118, as shown in FIG. 34 and corresponding enlarged successive fragmentary end and plan sectional views respectively shown in FIGS. 34*a* and 34*b*.

At the end of the downward stroke of the positioning cylinder 240 for the top cut grinding wheel and the top cut grinding wheel 238 has completed a top cut grinding cycle to form a front face tooth, as illustrated in FIG. 35 and corresponding enlarged fragmentary end and plan sectional views respectively shown in FIGS. 35*a* and 35*b*, said grinding wheel positioning cylinder 240 is de-energized and the grinding head return springs 242 return the grinding head assembly to a re-cycled start position while the workhead assembly 22 simultaneously retracts and indexes the in-process bur head workpiece 118 for the next successive sequential grinding operation to form the next front face tooth and this operation is sequentially repeated until the programmed completion of the total number of face tooth cuts have been made in the bur head.

It should be noted that adjustment of the grinding wheel for the angle of top cutting the bur head is effected about pivot bolt 244 and movement of adjustment slots 246 relative to bolts 248 which extend therethrough, and are tightened to secure a desired angle of adjustment. Micrometer wheel 250 is employed to make sideways adjustment of the grinding wheel 238 while micrometer wheel 252 is employed to make depth of cut adjustment of grinding wheel 238. The grinding head assembly is positioned relative to the re-cycled starting position thereof by engagement of stop member 254 on the grinding head assembly with the motor mount base 256, as clearly illustrated in FIG. 26.

DISCHARGE OF FINISHED BURS

Figure 27:
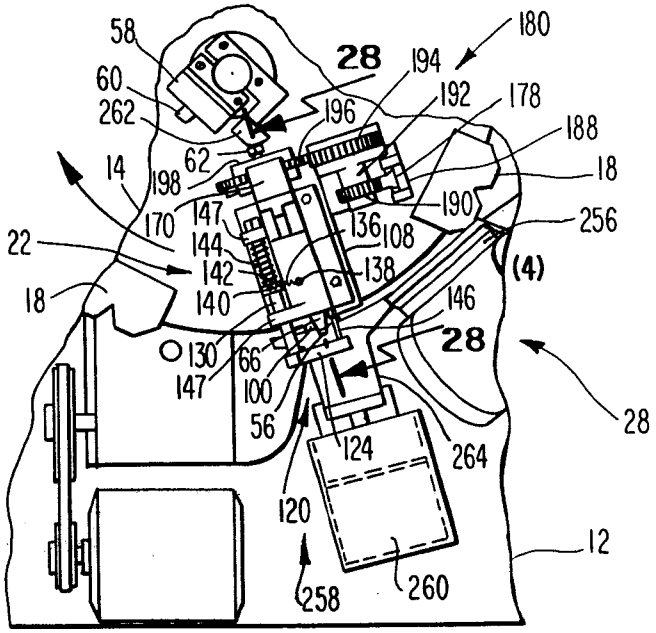
FIG. 27 is a fragmentary enlarged plan view of the completed bur head automatic eject station generally as seen in FIG. 1, but, however, showing the workhead assembly collet clamping means in the eject position.

Upon completion of the top cut grinding cycles, as heretofore described, the indexing table 14 initiates another clockwise indexing displacement cycle to register and lock the subject workhead assembly 22 in operative position at Station 1, which is the bur blank loading station 26, and in moving to said station, automatic bur eject station 258 is traversed, as illustrated in FIG. 27, and ejects, on the fly, the completed bur from clamped engagement by the collet clamping jaws 56 of said subject workhead assembly 22, into the bur head receptacle 206 which receives completed burs. Automatic bur head ejection is accomplished by simultaneous cammed engagement of the outer end of collet pusher rod 62 at the rear of said workhead 22 with the stationary cam 262 and the engagement of the face cam 100 of base mount 108 of the workhead assembly with the face cam follower 264 at the ejection station, thereby causing the workhead spindle 202 to be sufficiently cammed forward to enable the collet clamping jaws 56 to open, and thereby also enable the force of the collet ejector spring 94 to instantly force the collet ejector rod 92 forward and "fire" the completed dental bur 30 into the head receptacle 260, the sequence of which is respectively illustrated in FIGS. 27 and 28.

The indexing table 14 then proceeds to complete the clockwise indexing movement for its complete cycle to position and lock said subject workhead assembly 22 in registered position with bur blank loading station 26 at Station (1) for reloading and concurrent operational re-cycling to grindably form another dental bur by the machine 10 as heretofore detailed and described.

The machine 10 as disclosed in FIG. 1, and the subsequently described accompanying Figures, is preferably constructed of metal, plastic, and composition materials, but any other suitable materials or combinations thereof may be used.

It should be further pointed out that, in the machine 10:

(1) The in-process bur head workpiece 118 "sees" the respective bur head groove cut grinding wheel 152 at Station (2), the bur head relief cut grinding wheel 232 at Station (3), and the bur head top cut grinding wheel 238 at Station (4) as an ellipse rather than a circle, thereby making possible the formation of the helically cut bur head configurations heretofore described by grinding.

(2) The groove cutting of burs at Station (2), mechanically, is the most difficult to achieve of all the grinding operations and removes the greatest amount of in-process bur head material, whereby said station consequently controls and determines the concurrent functioning speed at which all of the operational Stations (1)–(4) may be programmed and set to operate.

(3) The main functional groups of the machine 10 comprising the indexing table 14, Geneva gear drive 16, indexing lock station 20, bur blank loading station 26, operational grinding Stations (2), (3) and (4), automatic bur eject station 258, are set and mechanically coordinated through the machine 10 control panel.

(4) The larger size grinding wheels are employed in the machine 10 not only to increase service life, as heretofore pointed out, but also to prevent cutting into the workhead assembly collet clamping jaws 56 during grinding operations.

(5) Indexing of the in-process bur head workpiece 118 on respective grinding station return re-cycles is for the specific purpose of conserving processing time.

While the invention has been described and illustrated in its several preferred embodiments, it should be understood that the invention is not to be limited to the precise details herein illustrated and described since the same may be carried out in other ways falling within the scope of the invention as illustrated and described.

We claim:

1. A loading unit for a bur grinding machine adapted to receive from a supply thereof blank burs comprising shanks having heads on one end thereof requiring flutes to be ground therein to form cutting teeth therebetween, said unit comprising in combination a base plate adapted to be secured to a bur grinding machine, an inlet guide member on said base plate, another plate fixed at a right-angle to said base plate, said base plate having a first aperture therein to receive blank burs from a source, and a second aperture therein, a transfer member supported by said base plate and parallel thereto for movement within a substantially vertical plane and having a bur-receiving space therein which in one position of said member is aligned with said first aperture of said inlet guide member and in a second position thereof said member blocks passage of burs from said inlet guide member and disposes said bur-receiving space in axial alignment with said second aperture in said another plate and also with a bur-receiving collet when said loading unit is mounted upon said machine, plunger means mounted upon said another plate and having one end aligned with said bur-receiving space in said transfer member when in said second position thereof, means engageable with said transfer member and operable to move the same positively from said one position to said second position, said transfer member being provided with a blade mounted thereon for limited movement relative to said bur-receiving space and cooperating therewith to form a socket to receive and position a bur blank upon said transfer member, said blade having an outer end projecting beyond said transfer member, means normally engaging said blade to urge the same toward said space, and means on said base plate engageable by said projecting outer end of said blade immediately prior to said transfer member reaching said one position and operable to move and hold said blade slightly spaced from said space to increase the cross-sectional size of said socket and thereby permit free movement of a bur blank into said bur-receiving space from said inlet guide member.

* * * * *